US007541731B2

(12) United States Patent
Sata et al.

(10) Patent No.: US 7,541,731 B2
(45) Date of Patent: Jun. 2, 2009

(54) FLAT-PANEL DISPLAY

(75) Inventors: Hiroshi Sata, Kanagawa (JP); Satoshi Okanan, Gifu (JP); Keiji Honda, Aichi (JP); Yoshimitsu Kato, Kanagawa (JP); Atsushi Seki, Gifu (JP)

(73) Assignee: Sony Corporation, Tokyo (JP)

( * ) Notice: Subject to any disclaimer, the term of this patent is extended or adjusted under 35 U.S.C. 154(b) by 354 days.

(21) Appl. No.: 11/465,506

(22) Filed: Aug. 18, 2006

(65) Prior Publication Data

US 2007/0046163 A1 Mar. 1, 2007

(30) Foreign Application Priority Data

Aug. 31, 2005 (JP) ..... P2005-250823
Jan. 30, 2006 (JP) ..... P2006-020840

(51) Int. Cl.
*H01J 1/66* (2006.01)

(52) U.S. Cl. ..... 313/496; 313/495

(58) Field of Classification Search ..... 313/495–497
See application file for complete search history.

(56) References Cited

U.S. PATENT DOCUMENTS 5,726,529 A * 3/1998 Dean et al. ..... 313/495
5,828,352 A * 10/1998 Nomura et al. ..... 345/74.1
5,905,335 A * 5/1999 Fushimi et al. ..... 313/495
5,990,613 A * 11/1999 Ageno et al. ..... 313/495
6,600,263 B1 * 7/2003 Ito ..... 313/495
6,677,706 B1 1/2004 Hara et al.
2003/0164675 A1 * 9/2003 Ando ..... 313/495
2005/0276096 A1 12/2005 Hara et al.

FOREIGN PATENT DOCUMENTS

JP 10-326583 12/1998
JP 2000-082428 3/2000
JP 2000-306510 11/2000
JP 2003323853 A * 11/2003

* cited by examiner

*Primary Examiner*—Nimeshkumar D. Patel
*Assistant Examiner*—Christopher M Raabe
(74) *Attorney, Agent, or Firm*—Sonnenschein Nath & Rosenthal LLP

(57) ABSTRACT

A flat-panel display includes a cathode panel including a plurality of electron emission regions, and an anode panel including a fluorescent layer and an anode electrode, both panels being bonded together in a peripheral region and holding a vacuum space therebetween; a plurality of spacers disposed between the cathode panel and the anode panel; a high-resistance layer provided between the anode panel and each of the spacers; and a conductor layer provided on a portion of each of the spacers which contacts the cathode panel.

6 Claims, 22 Drawing Sheets

ANGLE DISTRIBUTION
OF INCIDENT ELECTRON

FLAT-PANEL DISPLAY

CROSS REFERENCES TO RELATED APPLICATIONS

The present invention contains subject matter related to Japanese Patent Application JP 2005-250823 filed in the Japanese Patent Office on Aug. 31, 2005 and Japanese Patent Application JP 2006-020840 filed in the Japanese Patent Office on Jan. 30, 2006, the entire contents of which are incorporated herein by reference.

BACKGROUND OF THE INVENTION

1. Field of the Invention

The present invention relates to a flat-panel display.

2. Description of the Related Art

Various flat-panel displays have been investigated as image displays alternative to cathode ray tubes (CRT) which are now mainstream. Such flat-panel displays are exemplified by liquid crystal displays (LCD), electroluminescence displays (ELD), and plasma display panels (PDP). In addition, the development of flat-panel displays combined with electron emission devices has been advanced. Known examples of the electron emission devices include a cold-cathode field electron emission device, a metal/insulator/metal device (also referred to as a "MIM device"), and a surface-conduction electron emission device. The flat-panel displays combined with these electron emission devices each including a cold-cathode electron source have attracted attention from the viewpoints of high resolution, bright color display, and low power consumption.

A cold-cathode field electron emission display (may be abbreviated to a "display" hereinafter) used as a flat-panel display combined with a cold-cathode field electron emission device generally includes a cathode panel having an electron emission region corresponding to each of pixels arrayed in a two-dimensional matrix, and an anode panel having a fluorescent layer which is exited by collision with electrons emitted from the electron emission region to emit light, both panels being opposed to each other with a vacuum layer provided therebetween. Generally, at least one cold-cathode field emission device (may be abbreviated to a "field emission device" hereinafter) is provided in the electron emission region. The field emission device may be a spinto type, a flat type, an edge type, a planar type, or the like.

FIG. 9 is a conceptual partial end view showing an example of a display having a spinto-type field emission device, and FIG. 11 is an exploded schematic perspective view showing portions of a cathode panel CP and an anode panel AP. The spinto-type field emission device constituting the display includes a cathode electrode 11 formed on a support 10, an insulating layer 12 formed on the support 10 and the cathode electrode 11, a gate electrode 13 formed on the insulating layer 12, apertures 14 (first apertures 14A formed in the gate electrode 13 and second apertures 14B formed in the insulating layer 12) provided in the gate electrode 13 and the insulating layer 12, and conical electron emission parts 15 formed on the cathode electrode 11 so as to be disposed at the bottoms of the respective apertures 14.

Alternatively, FIG. 10 is a conceptual partial end view showing a display including a so-called flat field emission device having substantially planar electron emission parts 15A. The field emission device includes a cathode electrode 11 formed on a support 10, an insulating layer 12 formed on the support 10 and the cathode electrode 11, a gate electrode 13 formed on the insulating layer 12, apertures 14 (apertures 14A formed in the gate electrode 13 and apertures 14B formed in the insulating layer 12) provided in the gate electrode 13 and the insulating layer 12, and electron emission parts 15A formed on the cathode electrode 11 to be disposed at the bottoms of the respective apertures 14. The electron emission parts 15A include many carbon nanotubes partially buried in a matrix.

In these displays, the cathode electrode 11 is a stripe electrode extending in a first direction (the Y direction in the drawing), and the gate electrode 13 is a stripe electrode extending in a section direction (the X direction in the drawing) different from the first direction. The cathode electrode 11 and the gate electrode 13 are formed in stripes in different directions so that the projective images of both electrodes 11 and 13 are perpendicular to each other. The overlap region between the stripe-shaped cathode electrodes 11 and gate electrodes 13 serves as an electron emission region EA corresponding to one sub-pixel. The electron emission regions EA are generally arrayed in a two-dimensional matrix in an effective region which is a central display region having a display function as a practical function of a flat-panel display, an ineffective region being disposed outside the effective region to surround in a frame form the effective region.

On the other hand, the anode panel AP has a structure in which fluorescent layers 22 are formed in a predetermined pattern on a substrate 20 and are covered with an anode electrode 24. Specifically, the fluorescence layers 22 include red light-emitting fluorescent layers 22R, green light-emitting fluorescent layers 22G, and blue light-emitting fluorescent layers 22B. Furthermore, light absorbing layers (black matrix) 23 composed of a light absorbing material such as carbon or the like are buried between the respective fluorescent layers 22, for preventing the occurrence of color blurring of a display image or optical crosstalk. In the figures, reference numeral 21 denotes a partition wall; reference numeral 40, a spacer; reference numeral 25, a spacer support part; reference numeral 26, a frame; reference numeral 17, a converging electrode; and reference numeral 16, an interlayer insulating layer. In FIGS. 10 and 11, the partition wall, the spacer, the spacer support part, and the converging electrode are omitted.

The anode electrode 24 has the function as a reflective film reflecting light emitted from the fluorescent layers 22, the function as a reflective film reflecting electrons recoiling from the fluorescent layers 22 or secondary electrons (generically called "backscattered electrons" hereinafter) emitted from the fluorescent layers 22, and an antistatic function for the fluorescent layers 22. The partition wall 21 has the function to prevent the occurrence of so-called optical crosstalk (color blurring) due to collision of the backscattered electrons with the other fluorescent layers 22.

Each sub-pixel includes the electron emission region EA on the cathode panel side, and the fluorescent layer 22 on the anode panel side opposing a group of the field emission devices. The sub-pixels of the order of hundreds of thousands to millions are arrayed in the effective region.

The anode panel AP and the cathode panel CP are arranged so that the electron emission regions EA oppose the fluorescent layers 22, bonded together through the frame 26 in a peripheral region, evacuated, and then sealed to produce a display. The space surrounded by the anode panel AP, the cathode panel CP, and the frame 26 has a high degree of vacuum (for example, $1\times10^{-3}$ Pa or less).

Therefore, the display is damaged by the atmospheric pressure unless the spacers 40 composed of, for example, a ceramic material or glass are disposed between the anode panel AP and the cathode panel CP. Furthermore, an antistatic film (not shown) composed of, for example, $CrO_x$ or $CrAl_xO_y$, is formed on the side surface of each spacer 40.

FIGS. 18, 19, and 20 each schematically show the orbits of electrons or electron beams of the sub-pixels disposed near the spacers 40. In FIGS. 18, 19, and 20, the anode electrode, the light absorbing layers (black matrix), and the converging electrode are omitted. The gate electrodes 13 extend in the vertical direction (X direction) of the drawing, and the cathode electrodes 11 extend in a direction (Y direction) parallel to the drawing.

As shown in FIG. 18, electrons passing through the anode electrode (not shown) on the anode panel AP collide with the fluorescent layers 22. As shown in FIG. 19, the electrons are partially backscattered by the fluorescent layers 22, and the backscattered electrons or the like partially collide with the spacers 40.

The backscattered electrons or the like cause various problems.

That is, the backscattered electrons or the like partially collide with the spacers 40. In general, a material such as a ceramic material or glass having an excellent withstand voltage has a relatively high total secondary electron emission coefficient (TSEEY), and the total secondary electron emission coefficient exceeds 1 in a wide energy region in which electrons collide with the spacers 40. The total secondary electron emission coefficient (TSEEY) is represented by a total of a secondary electron emission coefficient (SEEC) and a backscattered electron coefficient (BC). As shown in FIG. 21, the total secondary electron emission coefficient is a function of electron beam energy and is maximized near 450 eV in almost all substances. Also, the total secondary electron emission coefficient changes with the angle θ of incidence on a surface of a material. FIG. 21 shows a relation between the electron beam energy and the total secondary electron emission coefficient (TSEEY) at each of the incidence angles θ of 0°, 30°, 60°, and 80°. FIG. 21 also indicates that when electrons are incident obliquely on the spacers 40, the total secondary electron emission coefficient is increased.

FIG. 22A shows an energy distribution of electrons colliding with the spacers 40, and FIG. 22B shows an angle distribution of electrons colliding with the spacers 40. When electron beams with an energy of 10 keV are applied to the fluorescent layers 22, backscattered electrons or the like move toward the cathode panel side. However, since the electric field on the anode panel side is positive, so-called parabolic orbits are created. Therefore, the electrons are incident (collide) on the spaces 40 with various energies (refer to FIG. 22A) and at various angles (refer to FIG. 22B). Ideally, when the total secondary electron emission coefficient of the side surfaces of the spacers 40 is 1, charge-up does not occur in the side surfaces of the spacers 40. However, it may be impossible to control the total secondary electron emission coefficient to 1 for electrons incident (colliding) on the spacers 40 at various angles and with various energies.

As a result, a positive charge occurs in the side surfaces of the spacer 40, and parallel electric fields near the spacers 40 are bent, thereby bending electron beam orbits. Furthermore, bending the electron beam orbits causes further collision of electrons with the spacers 40, and charge-up in the spacers 40 is further increased, thereby further bending the electron beam orbits (refer to FIG. 20). In this state, electron beams do not collide with the desired fluorescent layers 22 due to the disturbance of the electron beam orbits near the spacers 40 and thus the formed image is distorted near the spacers 40. As a result, the formation of an image is significantly affected, and the spacers 40 become visible. In addition, in some cases, the components of a display may be damaged by creeping discharge due to the positive charge. Furthermore, degradation in the antistatic film formed on the side surfaces of the spacers 40 changes with time due to the positive charge, and the antistatic films are decreased in resistance, thereby causing the problem of distorting the electric fields and bending the electron beam orbits. Therefore, it is a very important technical matter to rapidly remove the electric charge from the side surfaces of the spacers 40.

A technique for rapidly removing the electric charge from the sides of spacers is disclosed in, for example, U.S. Pat. No. 3,099,003. In the technique disclosed in this patent publication, a spacer includes an insulating base and a two-layer film including first and second layers formed on the side surface of the insulating base. It is also disclosed that the electric charge accumulated in the spacer is rapidly removed through the first layer.

In order to rapidly remove the electric charge from the side surface of a spacer, for example, U.S. Pat. No. 3,466,981 discloses a technique of forming a low-resistance film on each of portions of a spacer which contact an anode panel component and a cathode panel component, respectively.

SUMMARY OF THE INVENTION

As a result of investigation, the inventors found that even when, as disclosed in U.S. Pat. No. 3,466,981, a low-resistance film is formed on each of portions of a spacer which contact an anode panel component and a cathode panel component, respectively, it may be impossible to effectively suppress the occurrence of a phenomenon that parallel an electric field is bent near a spacer due to the electric charge in the side surface of the spacer, thereby bending electron beam orbits.

Accordingly, it is desirable to provide a flat-panel display having a structure capable of rapidly removing electric charge from the side surface of a spacer and effectively suppressing the occurrence of a phenomenon that electron beam orbits are bent due to bending of a parallel electric field near the spacer.

In accordance with an embodiment of the invention, a flat-panel display includes a cathode panel including a plurality of electron emission regions, and an anode panel including fluorescent layers and an anode electrode, both panels being bonded together in a peripheral region and holding a vacuum space therebetween; a plurality of spacers disposed between the cathode panel and the anode panel; a high-resistance film provided between each of the spacers and the anode panel; and a conductor layer formed on a portion of each of the spacers which contacts the cathode panel.

In the flat-panel display according to the embodiment of the invention, the high-resistance layer is formed on a portion of each spacer which contacts the anode electrode. More specifically, the high-resistance layer is formed on the top surface or an upper portion of the side surface of each spacer, or formed from the top surface to an upper portion of the side surface of each spacer. Alternatively, the high-resistance layer may be formed on a portion of the anode panel which contacts each spacer, and more specifically formed on a portion of the anode electrode constituting the anode panel, not only a portion of the anode electrode but also the vicinity thereof, or a portion extending from a portion of the substrate constituting the anode panel to the anode electrode). In this case, the anode electrode includes a plurality of anode electrode units, and the anode electrode units may be electrically connected to each other with the high-resistance layers. When the anode electrode includes the plurality of anode electrode units, the capacitance between the anode electrode units and a cathode electrode may be decreased, thereby effectively preventing discharge. In addition, since a voltage is supplied to the anode electrode units through the high-resistance films, even when small-scale discharge occurs, the growth to large-scale discharge may be suppressed. However, the spacers are composed of a dielectric material, and thus the capacitance between the anode electrode unit and the cathode electrode near each spacer is increased to decrease the effect of preventing spark discharge. In the above-described constitution, the spacers are in contact with the high-resistance films. Since the discharge current is suppressed by contact between the spacers and the high-resistance films, it may be possible to compensate for a decrease in the spark discharge preventing effect due to an increase in the capacitance. In accordance with another embodiment of the invention, an antistatic film may be formed on the surface of each spacer. In this case, when the antistatic film is composed of a high-resistant material, the antistatic film may be formed to extend to the anode panel-side top surface of each spacer. Furthermore, each spacer may be in contact with the high-resistance film through the antistatic film. According to demand, a second high-resistance layer may be provided on a portion of each spacer which contacts the high-resistance film, for example, a portion extending from the top surface of each spacer in contact with the high-resistance layer to an upper portion of the side thereof. The surface resistance of the second high-resistance layer is preferably higher than that of the above-described high-resistance layers.

When the above-described high-resistance layer is formed on a portion of each spacer which contacts the anode electrode or the high-resistance layer is formed on a portion of the anode panel which contacts each spacer, the material constituting the high-resistance layers is exemplified by carbon materials such as silicon carbide (SiC), SiCN, graphite, and amorphous carbon; SiN; high-melting-point metal oxides or metal oxides such as ruthenium oxide ($RuO_2$), tantalum oxide, and tantalum nitride; high-melting-point metal nitrides or metal nitrides; high-melting-point metal carbides or metal carbides; mixtures of these materials; mixtures of fine particles of these metal; metal-insulator composite materials such as cermet; carbon materials having the form of modified (for example, doped or laser-modified) diamond; semiconductor-ceramic composite materials; intrinsic semiconductor materials; and semiconductor materials such as lightly doped (n-type or p-type) amorphous silicon. Examples of a method for producing the high-resistance layers include various physical vapor deposition methods (PVD method) such as a sputtering method and a vacuum evaporation method; various chemical vapor deposition method (CVD method); various printing methods such as a screen printing method, a ink-jet printing method, and a metal mask printing method; and various coating method such as a spray method. Furthermore, a plurality of films including a SiC resistance film and a low-resistance carbon thin film laminate thereon may be combined to realize a stable desired sheet resistivity value. This applies to the case in which the above-described second high-resistance layer is provided. The high-resistance layers may be formed by patterning by lithography and etching or patterning by a PVD method or a printing method through a mask or screen.

The high-resistance layer may include a high-resistance member which is held between the top surface of each spacer and the anode electrode. In this case, the material constituting the high-resistance member is exemplified by a layered (bulk-shaped) material and a tape-shaped material, which are prepared by an appropriate method using any one of the above-described materials for constituting the high-resistance layer. Alternatively, the high-resistance member may have a bonding function to fix each spacer and the anode electrode. In this case, the material constituting the high-resistance member is exemplified by a high-resistance adhesive prepared by mixing a proper amount of a conductive filler or a conductive material such as a metal with an insulating adhesive to control the adhesive to desired resistivity, and high-resistance frit glass prepared by mixing a proper amount of a conductive filler or a conductive material such as a metal with insulating frit glass to control the glass to desired resistivity.

In the flat-panel display according to any one of the embodiments of the invention including the above-described preferred constitutions, the sheet resistivity of the high-resistance layer is $1\times10^{-2}$ $\Omega\cdot m^2$ to $1\times10^{5}$ $\Omega\cdot m^2$ and preferably 1 $\Omega\cdot m^2$ to $1\times10^{5}$ $\Omega\cdot m^2$. When the sheet resistivity of the high-resistance layer is excessively high, discharge may occur between each spacer and the anode electrode. Therefore, the sheet resistivity is preferably as high as possible in a range causing no discharge.

In the flat-panel display according to any one of the embodiments of the invention including the above-described preferred constitutions, the sheet resistivity of the conductor layer is preferably $1\times10^{-3}$ $\Omega\cdot m^2$ or less. The sheet resistivity of the conductor layer is preferably as low as possible because the positive electric charge accumulated in the side surface of each spacer is released at a higher speed. The excessively low sheet resistivity has no problem. Examples of the material constituting the conductor layer include metals such as aluminum (Al), tungsten (W), niobium (Nb), tantalum, (Ta), molybdenum (Mo), chromium (Cr), copper (Cu), gold (Au), silver (Ag), titanium (Ti), nickel (Ni), cobalt (Co), zirconium (Zr), iron (Fe), platinum (Pt), and zinc (Zn); alloys containing these metal elements (e.g., MoW) or compounds containing these metal elements (e.g., nitrides such as TiN, and silicides such as $WSi_2$, $MoSi_2$, $TiSi_2$, and $TaSi_2$); semiconductors such as silicon (Si); carbon thin films of diamond; and conductive metal oxides such as ITO (indium tin oxide), indium oxide, and zinc oxide. Examples of a method for forming the conductor layer include various PVD methods such as a sputtering method and a vacuum evaporation method; various CVD methods; and various printing methods.

In the flat-panel display according to any one of the embodiments of the invention including the above-described preferred constitutions and forms (simply generally named "according to an embodiment of the invention" hereinafter), the spacers may be composed of, for example, ceramic or glass. When the spacers are composed of ceramic, examples of ceramic include mullite, alumina, barium titanate, lead titanate zirconate, zirconia, cordierite, barium borosilicate, iron silicate, glass ceramic materials, and mixtures of these materials with titanium oxide, chromium oxide, iron oxide, vanadium oxide, or nickel oxide. In this case, the spacers may be produced by forming a so-called green sheet, firing the green sheet, and cutting the fired produce of the green sheet. The spacers are preferably chamfered at the edges to remove projections or the like. The spacers are preferably fixed by, for example, holding between the partition walls which are provided on the anode panel and which will be described below, or forming spacer holding parts on the anode panel and/or the cathode panel. Alternatively, the spacers may be held on the anode panel and/or the cathode panel using an adhesive or the like.

The resistance between the top surface and the bottom surface of each spacer is, for example, $1\times10^{8}$ $\Omega$ to $1\times10^{11}$ $\Omega$ and preferably $3\times10^{9}$ $\Omega$ to $2\times10^{10}$ $\Omega$, with the voltage of 1 kV applied in measurement. In each spacer having a top area and a bottom area of $1.1\times10^{-5}$ $m^2$ each, the resistivity value is, for example, $6\times10^{5}$ $\Omega\cdot m$ to $6\times10^{8}$ $\Omega\cdot m$ and preferably 1.8×

$10^7$ Ω·m to $1.2\times10^8$ Ω·m, with the voltage of 1 kV applied in measurement. When the resistance of the spacers is excessively low, an excessive current flows from the anode panel to the cathode panel through the spacers, and consequently the power consumption of the flat-panel display may be increased. When an excessive current flows through the spacers, heat is generated from the spacers, thereby decreasing the resistance value of the spacers according to the temperature characteristics (TCR: Temperature Resistance Coefficient) of the resistance of the spacers. As a result, so-called thermal runaway may occur, in which the current flowing is increased to further generate heat. On the other hand, when the resistance of the spacers is excessively high, the rate of removal of positive electric charge accumulated in the side surfaces of the spacers may be decreased, thereby causing a problem with breakdown voltage or image quality due to electrification.

The antistatic film may be provided on the side surface of each spacer. The material constituting the antistatic films preferably has a secondary electron emission coefficient close to 1, and a semimetal such as graphite, an oxide, a boride, a carbide, a sulfide, or a nitride may be used as the material constituting the antistatic films. Examples of the material include semimetals such as graphite; compounds containing semimetals, such as $MoSe_2$; oxides such as $CrO_x$, $CrAl_xO_y$, manganese oxide, $Nd_2O_3$, $La_xBa_{2-x}CuO_4$, $La_xBa_{2-x}CuO_4$, and $La_xY_{1-x}CrO_3$; borides such as $AlB_2$ and $TiB_2$; carbides such as SiC; sulfides such as $MoS_2$ and $WS_2$; compounds such as tungsten nitride and germanium nitride; and nitrides such as BN, TiN, and AlN. Further examples include the materials disclosed in PCT Japanese Translation Patent Publication No. 2004-500688. The antistatic films may be composed of a single material or a plurality of materials and may have a single-layer structure or a multilayer structure. The antistatic films may be formed by a known method such as a sputtering method, a vacuum evaporation method, or a CVD method.

The flat-panel display according to any one of the embodiments of the invention may be a cold-cathode field electron emission display having an electron emission region including at least one cold-cathode field electron emission device (abbreviated to a "field emission device" hereinafter), a flat-panel display having an electron emission region including a metal/insulator/metal type device (referred to as an "MIN device"), or a flat-panel display having an electron emission region including a surface-conduction electron-emission device.

When the flat-panel display is a cold-cathode field electron-emission display, the electron emission region emitting electrons includes at least one field emission device including the following components:

(a) a cathode electrode formed on a support and extending in a first direction;

(b) an insulating layer formed on the cathode electrode and the support;

(c) a stripe-shaped gate electrode formed on the insulating layer and extending in a second direction different from the first direction;

(d) apertures provided in the gate electrode and the insulating layer in the overlap region between the cathode electrode and the gate electrode to expose the cathode electrode at the bottoms thereof; and (e) an electron emission part provided on the cathode electrode exposed at the bottom of each of the apertures.

The type of the field emission device may be, but is not particularly limited thereto, a spinto-type field emission device including a conical electron emission part provided on a cathode electrode which is disposed as the bottom of each aperture, or a flat field emission device including a substantially flat electron emission part provided on a cathode electrode which is disposed at the bottom of each aperture.

In the cathode panel, the projective images of the cathode electrodes and the projective images of the gate electrodes are preferably perpendicular to each other, i.e., the first and second directions are perpendicular to each other, from the viewpoint of simplification of the structure of the cold-cathode field electron emission display. The overlap regions of the cathode electrode and the gate electrodes correspond to the respective electron emission regions, and the electron emission regions are arranged in a two-dimensional matrix in the effective region of the cathode panel.

In the cold-cathode field electron emission display, a strong electric field created by the voltage applied to the cathode electrodes and the gate electrodes is applied to the electron emission parts, and consequently electrons are emitted from the electron emission parts by a quantum tunneling effect. The emitted electrons are attracted to the anode panel by the anode electrode provided on the anode panel and collide with the fluorescent layers. As a result of collision of the electrons with the fluorescent layers, an image is recognized due to light emission from the fluorescent layers.

In the cold-cathode field electron emission display, the cathode electrodes are connected to a cathode electrode control circuit, the gate electrodes are connected to a gate electrode control circuit, and the anode electrodes are connected to an anode electrode control circuit. As these control circuits, known circuits may be used. During an actual operation, the voltage (anode voltage) VA applied to the anode electrodes from the anode electrode control circuit is generally constant at, for example, 5 kV to 15 kV. When the distance between the anode panel and the cathode panel is $do_0$ (0.5 mm$\leqq d_0 \leqq$10 mm), the $V_A/d_0$ value (unit: kV/mm) is 0.5 to 20, preferably 1 to 10, and more preferably 4 to 8. In an actual operation of the cold-cathode field electron emission display, a voltage modulation system may be used as a gradient control system for the voltage $V_C$ applied to the cathode electrodes and the voltage $V_G$ applied to the gate electrodes.

The field emission device may be manufactured by a method including the following steps:

(1) the step of forming the cathode electrode on the support;

(2) the step of forming the insulating layer over the entire surface (the support and the cathode electrode);

(3) the step of forming the gate electrode on the insulating layer;

(4) the step of forming the apertures in the gate electrode and the insulating layer in the overlap region between the cathode electrode and the gate electrode to expose the cathode electrode at the bottoms of the apertures; and (5) the step of forming the electron emission part on the cathode electrode exposed at the bottom of each of the apertures.

Alternatively, the field emission device may be manufactured by a method including the following steps:

(1) the step of forming the cathode electrode on the support;

(2) the step of forming the electron emission part on the cathode electrode;

(3) the step of forming the insulating layer over the entire surface (the support and the electron emission part or the support, the cathode electrode, and the electron emission part);

(4) the step of forming the gate electrode on the insulating layer; and (5) the step of forming the apertures in the gate electrode and the insulating layer in the overlap region between the cathode electrode and the gate electrode to expose the cathode electrode at the bottoms of the apertures.

The field emission device may include a converging electrode. Namely, the field emission device may further include an interlayer insulating layer provided on the gate electrode and the insulating layer and the converging electrode provided on the interlayer insulating layer or the converging electrode provided above the gate electrode. The converging electrode is an electrode for converging the orbits of the electrons emitted from the apertures toward the anode electrode, thereby improving luminance and preventing optical crosstalk between the adjacent pixels. The converging electrode is particularly effective in the cold-cathode field electron emission display which is a so-called high voltage type in which the potential difference between the anode electrode and the cathode electrodes is the order of several kilovolts or more, and the distance between the anode electrode and the cathode electrodes is relatively long. A relatively negative voltage (e.g., 0 V) is applied to the converging electrode from a converging electrode control circuit. The converging electrode may not be independently formed to surround each electron emission part or electron emission region provided in the overlap region between the cathode electrode and the gate electrode. For example, the converging electrode may be extended in a predetermined arrangement direction of the electron emission parts or the electron emission regions or may be formed to surround all electron emission parts or all electron emission regions. In other words, the converging electrode may be formed in a sheet structure covering the entire effective region serving as the central display region actually functioning as the cold-cathode field electron emission display. In this case, a common converging effect is exhibited for a plurality of the electron emission parts or the electron emission regions.

In the spinto-type field emission device, as a material constituting the electron emission parts, at least one material may be selected from the group consisting of molybdenum, molybdenum alloys, tungsten, tungsten alloys, titanium, titanium alloys, niobium, niobium alloys, tantalum, tantalum alloys, chromium, chromium alloys, and impurity-containing silicon (polysilicon and amorphous silicon). In the spinto-type field emission device, the electron emission parts may be formed by a method other the vacuum evaporation method, such as a sputtering method or CVD method.

In the flat-type field emission display, the electron emission parts are preferably formed using a material having a smaller work factor p than that of a material used for forming the cathode electrodes. The material may be determined on the basis of the work function of the material constituting the cathode electrodes, the potential difference between the gate electrodes and the cathode electrodes, the desired current density of the emitted electrons, etc. Alternatively, the material constituting the electron emission parts may be appropriately selected to have a larger secondary electron gain δ than that of a conductive material constituting the cathode electrodes. In the flat-type field emission device, the material constituting the electron emission parts is particularly preferably carbon, more specifically, amorphous diamond or graphite, a carbon nanotube structure (carbon nanotubes and/or graphite nanofibers), ZnO whiskers, MgO whiskers, $SnO_2$ whiskers, MnO whiskers, $Y_2O_3$ whiskers, NiO whiskers, ITO whiskers, $In_2O_3$ whiskers, or $Al_2O_3$ whiskers. The material constituting the electron emission parts may not have electric conductivity.

Examples of materials constituting the cathode electrodes, the gate electrodes, and the converging electrode include metals such as aluminum (Al), tungsten (W), niobium (Nb), tantalum (Ta), molybdenum (Mo), chromium (Cr), copper (Cu), gold (Au), silver (Ag), titanium (Ti), nickel (Ni), cobalt (Co), zirconium (Zr), iron (Fe), platinum (Pt), and zinc (Zn); alloys containing these metals, e.g., MoW, or compounds containing these metals, e.g., nitride such as TiN, and silicides such as $WSi_2$, $MoSi_2$, $TiSi_2$, and $TaSi_2$; semiconductors such as silicon (Si); carbon thin films of diamond; and conductive metal oxides such as ITO (indium tin oxide), indium oxide, and zinc oxide. These electrodes may be formed by, for example, combination of an etching method and an evaporation method such as an electron beam evaporation or thermal filament evaporation method, a sputtering method, a CVD method, or an ion plating method; a printing method; a plating method such as an electroplating or electroless plating method; a liftoff method; a laser abrasion method; or a sol-gel method. The printing method and plating method are capable of directly forming, for example, the stripe-shaped cathode electrodes and gate electrodes.

Examples of materials constituting the insulating layer and the interlayer insulating layer include $SiO_2$-based materials such as $SiO_2$, BPSG, PSG, BSG, AsSG, PbSG, SiON, SOG (spin-on glass), low-melting-point glass, and glass paste; SiN-based materials; and insulating resins such as polyimide. These materials may be used alone or in appropriate combination. The insulating layer and the interlayer insulating layer may be formed by a known process such as a CVD process, a coating process, a sputtering process, or a printing process.

In a section of each aperture along an assumed plane parallel to the support surface, the planar shape of each of the first apertures (formed in the gate electrodes) or the second apertures (formed in the insulating layer) may be any shape such as a circle, an ellipse, a rectangle, a polygon, a rounded rectangle, a rounded polygon, or the like. The first apertures may be formed by, for example, anisotropic etching, isotropic etching, or combination of anisotropic etching and isotropic etching, or may be directly formed according to the method for forming the gate electrodes. The second apertures may be formed by, for example, anisotropic etching, isotropic etching, or combination of anisotropic etching and isotropic etching.

The field emission device may contain one electron emission part or a plurality of electron emission parts in each aperture, depending on the structure of the field emission device. Alternatively, a plurality of first apertures may be formed in the gate electrodes, and a second aperture may be formed in the insulating layer so as to communicate with the first apertures, at least one electron emission part being provided in the second aperture provided in the insulating layer.

In the field emission device, a resistor film may be provided between the cathode electrode and the electron emission part. By providing the resistor film, the operation of the field emission device is stabilized, and the electron emission properties are uniformed. Examples of a material constituting the resistor film include carbon materials such as silicon carbide (SiC) and SiCN; SiN; semiconductor materials such as amorphous silicon; and high-melting-point metal oxides such as ruthenium oxide ($RuO_2$), tantalum oxide, and tantalum nitride. The resistor film may be formed by a sputtering process, a CVD process, or a printing process. The electric resistance value of each electron emission part is about $1\times10^6$ to $1\times10^{11}$ and preferably several tens giga Ω.

As the support constituting the cathode panel or the substrate constituting the anode panel, a glass substrate, a glass substrate having an insulating film formed on a surface thereof, a quartz substrate, a quartz substrate having an insulating film formed on a surface thereof, or a semiconductor substrate having an insulating film formed on a surface thereof may be used. However, from the viewpoint of reduction in manufacturing cost, a glass substrate or a glass substrate having an insulating film formed on a surface thereof is preferably used. Examples of the glass substrate include high-strain-point glass, soda glass ($Na_2O.CaO.SiO_2$), silicate glass ($Na_2O.B_2O_3.SiO_2$), forsterite ($2Mg_2O.SiO_2$), lead glass ($Na_2O.PbO.SiO_2$), and non-alkali glass.

In the flat-panel display, the anode electrode and the fluorescent layers may be formed in, for example, a structure (1) in which the anode electrode is formed on the substrate, and the fluorescent layers are formed on the anode electrode, or a structure (2) in which the fluorescent layers are formed on the substrate, and the anode electrode is formed on the fluorescent layers. In the structure (1), a so-called metal back film may be formed on the fluorescent layers so as to be electrically conducted to the anode electrode. In the structure (2), a metal back films may be formed on the anode electrode.

The anode electrode may be formed as one anode electrode as a whole or may include a plurality of anode electrode units. In the latter case, spaces are present between the respective anode electrode units. The anode electrode units are preferably electrically connected to each other with high-resistance layers. In an embodiment, the anode electrode units are electrically connected to each other with the high-resistance layers, the sheet resistivity value of the high-resistance layers is, for example, $1\times10^{-1}$ Ω/□ to $1\times10^{10}$ Ω/□ and preferably $1\times10^{3}$ Ω/□ to $1\times10^{8}$ Ω/□. The number (Q) of the anode electrode units may be two or more. For example, when the total number of the fluorescent layer rows is q, Q=q or q=kQ (k is an integer of 2 or more and preferably $10\leqq k\leqq100$ and more preferably $20\leqq k\leqq50$), or the number Q may be 1 plus the number of the spacers disposed with predetermined spaces or may coincide with the number of the pixels or sub-pixels or a fraction of the number of the pixels or sub-pixels. The anode electrode units may have the same size regardless of the positions thereof or have different sizes depending on the positions thereof. The high-resistance layer may be formed on one anode electrode as a whole.

The anode electrode (including the anode electrode units) may be formed using a conductive material layer. The conductive material layer is formed by, for example, a PVD method such as an evaporation method such as an electron beam evaporation method or a thermal filament method, a sputtering method, an ion plating method, or a laser abrasion method; a CVD method; a printing method; a liftoff method; or a sol-gel method. In other words, the conductive material layer may be formed using a conductive material and then patterned by lithography and etching to form the anode electrode. Alternatively, the conductive material layer may be formed by a PVD method or printing method through a mask or screen having the pattern of the anode electrode to form the anode electrode. The average thickness (when the partition walls are provided, the average thickness of the anode electrode on the top surfaces of the partition walls, as described below) of the anode electrodes formed on (or above) the substrate is, for example, $3\times10^{-8}$ m (30 nm) to $5\times10^{-7}$ m (0.5 μm) and preferably $5\times10^{-8}$ m (50 nm) to $3\times10^{-7}$ m (0.3 μm).

Examples of the material constituting the anode electrode include metals such as molybdenum (Mo), aluminum (Al), chromium (Cr), tungsten (W), niobium (Nb), tantalum (Ta), gold (Au), silver (Ag), titanium (Ti), cobalt (Co), zirconium (Zr), iron (Fe), platinum (Pt), and zinc (Zn); alloys or compounds containing these metals, e.g., nitride such as TiN and silicides such as $WSi_2$, $MoSi_2$, $TiSi_2$, and $TaSi_2$; semiconductors such as silicon (Si); carbon thin films of diamond; and conductive metal oxides such as ITO (indium tin oxide), indium oxide, and zinc oxide. In the embodiment in which the anode electrode units are electrically connected to each other with the high-resistance layers, the anode electrode is preferably formed using a conductive material which does not change the resistance value of the high-resistance layers.

The fluorescent layers may be composed of monochrome fluorescent particles or fluorescent particles of the three primary colors. The fluorescent layers are formed in a dot arrangement. Specifically, when the flat-panel display is a color display, the fluorescent layers are formed in a delta arrangement, a stripe arrangement, a diagonal arrangement, or a rectangle arrangement. Namely, a line of the fluorescent layers which are linearly arranged may be a line of red light-emitting fluorescent layers alone, a line of green light-emitting fluorescent layers alone, a line of blue light-emitting fluorescent layers alone, or a line including red light-, green light-, and blue light-emitting fluorescent layers which are arranged in order. In this case, the fluorescent layers are defined as fluorescent regions each of which produces a luminescent point in the flat-panel display. In addition, one pixel includes a group of one red light-emitting fluorescent layer, one green light-emitting fluorescent layer, and one blue light-emitting fluorescent layer, and one sub-pixel includes one red light-emitting fluorescent layer, one green light-emitting fluorescent layer, or one blue light-emitting fluorescent layer. The spaces between the adjacent fluorescent layers may be filled with light absorbing layers (black matrix) for improving the contrast.

The fluorescent layers may be formed using a luminescent crystal grain composition prepared from luminescent crystal grains. For example, a red light sensitive luminescent crystal grain composition (red light fluorescent slurry) may be applied over the entire surface, exposed to light, and then developed to form a red light-emitting fluorescent layer. Then, a green light sensitive luminescent crystal grain composition (green-light fluorescent slurry) may be applied over the entire surface, exposed to light, and then developed to form a green light-emitting fluorescent layer. Furthermore, a blue light sensitive luminescent crystal grain composition (blue-light fluorescent slurry) may be applied over the entire surface, exposed to light, and then developed to form a blue light-emitting fluorescent layer. Alternatively, a red light-emitting fluorescent slurry, a green light-emitting fluorescent slurry, and a blue light-emitting fluorescent slurry my be applied in order, and then exposed to light and developed in order to form respective fluorescent layers. The fluorescent layers may be formed by a screen printing method, an ink-jet printing method, a flow coating method, a sedimentation coating method, or a fluorescent film transfer method. Although the average thickness of the fluorescent layers on the substrate is not limited, the thickness is preferably 3 μm to 20 μm and preferably 5 μm to 10 μm. The fluorescent material constituting the luminescent crystal grains may be appropriately selected from known fluorescent materials. In a color display, fluorescent materials are preferably combined so that the color purities are close to the three primary colors defined by NTSC, a white balance is achieved in mixing the three primary colors, the afterglow time is short, and the afterglow times of the three primary colors are substantially the same.

From the viewpoint of improvement in contrast of a display image, the light absorbing layers absorbing light from the fluorescent layers are preferably formed between the adjacent fluorescent layers or between the partition walls and the substrate. The light absorbing layers function as a so-called black matrix. As a material constituting the light absorbing layers, a material absorbing 90% or more of the light emitted from the fluorescent layers is preferably selected. Examples of such a material include carbon; metal thin films of chromium, nickel, aluminum, molybdenum, or an alloy thereof; metal oxides, such as chromium oxide; metal nitrides such as chromium nitride; heat-resistant organic resins; and glass paste; glass paste containing conductive particles of a black pigment or silver. Specifically, a photosensitive polyimide resin, chromium oxide, or a chromium oxide/chromium laminated film may be used. In use of a chromium oxide/chromium laminated film, a chromium film is in contact with the substrate. The light absorbing layers may be formed by, for example, a combination of a vacuum evaporation method or sputtering method and an etching method, a combination of a vacuum evaporation, sputtering, or spin coating method and a liftoff method, a printing method, or a lithographic process, which is appropriately selected depending on the material used.

In addition, the partition walls are preferably provided for preventing the occurrence of optical crosstalk (color blurring) due to incidence of the electrons recoiling from one of the fluorescent layers or the secondary electrons emitted from one of the fluorescent layers on the other fluorescent layers or preventing the collision of the electrons recoiling from one of the fluorescent layers or the secondary electrons emitted from one of the fluorescent layers with the other fluorescent layers.

A method for forming the partition walls is exemplified by a screen printing method, a dry film method, a photosensitive method, a casting method, and a sand blasting method. In the screen printing method, apertures are formed in portions of a screen corresponding to the partition walls to be formed, and a material for forming the partition walls is passed through the apertures using a squeezee to form material layers for forming the partition walls on the substrate, followed by firing. In the dry film method, a photosensitive film is laminated on a substrate and removed, by exposure and development, from portions where the partitions walls are to be formed, and then a material for forming the partition walls is filled in the apertures formed by the removal and then fired. The photosensitive film is burned and removed by firing to leave the material for forming the partition walls as the partition walls. In the photosensitive method, a photosensitive material layer for forming the partition walls is formed on a substrate, patterned by exposure and development, and then fired (cured). In the casting method (extrusion method), a material layer for forming the partition walls, which is composed of an organic or inorganic material paste, is extruded from a mold (cast) onto a substrate to form a material layer for forming the partition walls, following by firing of the material layer. In the sand blasting method, a material layer for forming the partition walls is formed on a substrate, for example, using screen printing, metal mask printing, a roll coater, a doctor blade, or a nozzle ejection coater, dried. Then, the material layer is covered with a mask layer in portions where the partition walls are to be formed, and the material layer for forming the partition walls is removed from the exposed portions by sand blasting. After the partition walls are formed, the partition walls may be polished to planarize the top surfaces thereof.

In each of the partition walls, the planar shape of a portion (an aperture region corresponding to the inner contour line of a projective image of the side surface of each partition wall) surrounding the fluorescent layer may be, for example, a rectangular shape, a circular shape, an elliptical shape, an oblong shape, a triangular shape, a polygonal shape with five for more sides, a rounded triangular shape, a rounded rectangular shape, or a rounded polygonal shape. The planar shapes (planar shapes of the aperture regions) are arranged in a two-dimensional matrix to form lattice-shaped partition walls. The two-dimensional matrix may have, for example, a double-crossed arrangement or a staggered arrangement.

Examples of the material for forming the partition walls include photosensitive polyimide resins, lead glass colored in black with a metal oxide such as cobalt oxide, $SiO_2$, and low-melting-point glass paste. Furthermore, protective films composed of, for example, $SiO_2$, SiON, or AlN may be formed on the surfaces (top surfaces and side surfaces) of the partition walls, for preventing the release of gases from the partition walls due to collision of electron beams with the partition walls.

The cathode panel and the anode panel are bonded together in a peripheral region using an adhesive layer or combination of an adhesive layer and a bar or frame composed of an insulating rigid material such as glass or ceramic. When the frame and the adhesive layer are combined, the height of the frame is appropriately selected so that the opposing distance between the cathode panel and the anode panel is set to be larger than that set using the adhesive layer alone. As a material for forming the adhesive layer, frit glass such as $B_2O_3$—PbO frit glass or $SiO_2$—$B_2O_3$—PbO frit glass is generally used, but a so-called low-melting-point metal material having a melting point of about 120° C. to 400° C. may be used. Examples of such a low-melting-point metal material include In (indium: melting point 157° C.); indium-gold low-melting-point alloys; tin (Sn)-based high-temperature solders such as $Sn_{80}Ag_{20}$ (melting point 220° C. to 370° C.) and $Sn_{95}Cu_5$ (melting point 227° C. to 370° C.); lead (Pb)-based high-temperature solders such as $Pb_{97.5}Ag_{2.5}$ (melting point 304° C.), $Pb_{94.5}Ag_{5.5}$ (melting point 304° C. to 365° C.) and $Pb_{97.5}Ag_{1.5}Sn_{1.0}$ (melting point 309° C.); zinc (Zn)-based high-temperature solders such as $Zn_{95}Al_5$ (melting point 380° C.); tin-lead standard solders such as $Sn_5Pb_{95}$ (melting point 300° C. to 314° C.) and $Sn_2Pb_{98}$ (melting point 316° C. to 322° C.); and brazing alloys such as $Au_{88}Ga_{12}$ (melting point 381° C.) (all subscripts are shown by atomic %).

When the cathode panel, the anode panel, and the frame are bonded together, the three may be bonded at the same time, or one of the cathode panel and the anode panel may be first bonded to the frame, and then the other may be bonded to the frame. When the simultaneous bonding or tow-stage bonding is performed in a high vacuum atmosphere, a vacuum is formed in the space surrounded by the cathode panel, the anode panel, the frame, and the adhesive layer at the same time as the bonding. Alternatively, the space surrounded by the cathode panel, the anode panel, the frame, and the adhesive layer may be evacuated after the bonding of the three to form a vacuum. When the space is evacuated after the bonding, the pressure of the bonding atmosphere may be either normal pressure or reduced pressure, and the gas constituting the atmosphere may be air or an inert gas containing nitrogen gas or a gas (for example, Ar gas) belonging to the 0 group in the periodic table.

The space may be evacuated through an exhaust tube previously connected to the cathode panel and/or the anode panel. The exhaust tube is typically a glass tube or a hollow tube composed of a metal or alloy having a low thermal expansion coefficient (for example, an iron (Fe) alloy containing 42% by weight of nickel (Ni) or an iron (Fe) alloy containing 42% by weight of nickel (Ni) and 6% by weigh of chromium (Cr)). Also, the exhaust tube is bonded, using the above-descried frit glass or low-melting-point metal material, to the periphery of a through portion provided in the ineffective region (region surrounding in a frame form the effective region serving as the central display region actually functioning as a flat-panel display) of the cathode panel and/or the anode panel, and then sealed by thermal fusion or pressure fusion after a predetermined degree of vacuum is attained. When the whole of the flat-panel display is once heated and then cooled before sealing, residual gas is desirably released to the space and removed to the outside by evacuation.

The electrons colliding with the side surfaces of the spacers are of the following various types and have various energies:

(A) electrons emitted from the electron emission parts;

(B) electrons recoiling from the fluorescent layers (backscattered electrons);

(C) secondary electrons emitted from the fluorescent layers;

(D) secondary electrons produced on the side surfaces of the spacers due to electron collision with the side surfaces of the spacers;

(E) hopping electrons produced from the secondary electrons on the side surfaces of the spacers by the repetition of incidence, reflection, incidence, reflection, . . . on the side surfaces of the spacers; and (F) secondary hopping electrons produced from the hopping electrons by the repetition of incidence, reflection, incidence, reflection, . . . of new secondary electrons produced on the side surfaces of the spacers.

Although the sides of the spacers are electrically charged by these electrons, whether the sides of the spacers are positively or negatively charged greatly depends on the secondary electron emission coefficient depending on the electron energy, the incidence angle, the material constituting the side surfaces of the spacers, and the states of the side surfaces of the spacers, as described above.

In the flat-panel display, the side surfaces of the spacers are charged mainly due to the following electrons:

(B) the backscattered electrons;

(E) the hopping electrons; and (F) the secondary hopping electrons.

The energy bands of these electrons are mainly several hundreds eV to several kilo eV. In this region, the secondary electron emission coefficients of almost all substances are 1 or more, and thus the sides of the spacers are positively charged in most cases.

The positive charge on the side surfaces of the spacers flows to the cathode panel side at a low potential through the spacers (or the antistatic films). In this case, when the contact resistance between the spacers and the cathode panel is high, the positive charge accumulated in the side surfaces of the spacers (or the antistatic films) is little escaped. On the other hand, as disclosed in U.S. Pat. No. 3,466,981, when the contact resistance between the spacers and the anode electrode is low, possibly, the positive charge easily flows from the anode panel to the side surfaces of the spacers, and electrons easily flow from the spacers to the anode panel side. As a result, the positive charge is further accumulated in the side surfaces of the spacers (or the antistatic films).

In the flat-panel display according to any one of the embodiments of the invention, the conductor layer is formed on a potion of each spacer which contacts the cathode panel, and thus the positive charge in the side surfaces of the spacers (or the antistatic films) easily flows to the cathode panel side at a lower potential through the spacers (or the antistatic films). On the other hand, the high-resistance layer is provided between each spacer and the anode panel, the positive charge little flows from the anode panel to the side surfaces of the spacers, and electrons little flow from the spacers to the anode panel side. Therefore, it may be possible to suppress an increase in positive charge in the surface surfaces of the spacers (or the antistatic films) or to decrease the positive charge in the surface surfaces of the spacers (or the antistatic films). Consequently, it may be possible to effectively suppress the occurrence of a phenomenon that electron beam orbits are bent due to bending of parallel electric fields near the spacers.

The charge in the antistatic films changes degradation of the antistatic films with time, thereby causing the problem of decreasing the resistance of the antistatic films, distorting electric fields, and bending electron beam orbits. As a result, the long-term reliability of the flat-panel display may be decreased. However, the flat-panel display according to any one of the embodiments of the invention little causes this problem and is capable of preventing a decrease in reliability. Furthermore, it may be possible to suppress the occurrence of creeping discharge due to the charge in the side surfaces of the spacers.

As a result, it may be possible to provide a flat-panel display producing a high-quality display image and having the resistance to high current and high pressure, excellent long-term reliability, and a long time. Also, it may be possible to effectively suppress the occurrence of a phenomenon that electron beam orbits are bent, thereby realizing a flat-panel bright display capable of operating with a high emission current.

When the spacers are insulated from the anode panel, the whole spacers are put at the same potential (for example, 0 V) as that of the regions in contact with the cathode panel, and thus the potential difference per unit distance between the anode panel and the spacers is excessively increased, thereby causing discharge between the anode panel and the spacers.

DESCRIPTION OF THE PREFERRED EMBODIMENTS

Embodiments of the present invention will be described with reference to the drawings.

A first embodiment relates to a flat-panel display.

Specifically, a flat-panel display according the first embodiment or any one of second to fourth embodiments described below (may be referred to as the "first embodiment or the like" hereinafter) includes a cold-cathode field electron emission display (abbreviated to a "display" hereinafter). A schematic partial sectional view of a spinto-type cold-cathode field electron emission device (referred to as a "field emission device" hereinafter) in the display according to the first embodiment or the like is the same as in FIG. 9. A schematic partial sectional view of a flat-type field electron emission device is the same as in FIG. 10. An exploded schematic partial perspective view of a cathode panel CP and an anode panel AP is the same as in FIG. 11.

Figure 1:
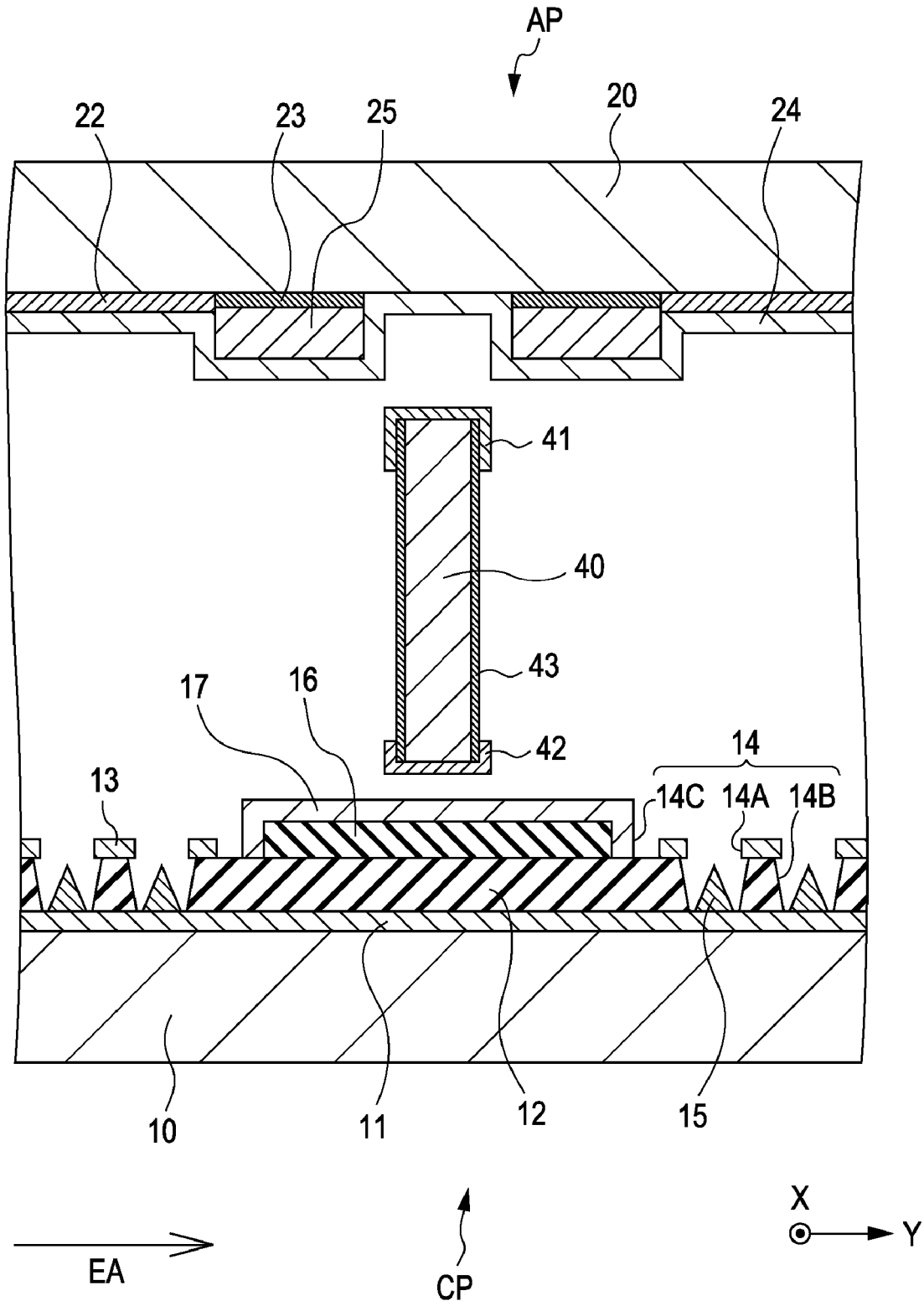
FIG. 1 is an enlarged schematic partial end view (exploded view) showing the vicinity of a spacer in a flat-panel display according to a first embodiment of the present invention.

Furthermore, FIG. 1 is an enlarged schematic partial end view (exploded view) showing the vicinity of a spacer according to the first embodiment.

The display according to the first embodiment or the like includes a cathode panel CP having a plurality of electron emission regions EA provided thereon, and an anode panel AP having fluorescent layers 22 and an anode electrode 24, both panels being bonded together in a peripheral region and holding a vacuum space therebetween. In addition, a plurality of spacers 40 is disposed between the cathode panel CP and the anode panel AP, the spacers 40 each having an antistatic film 43 formed on the side surface thereof.

Figure 9:
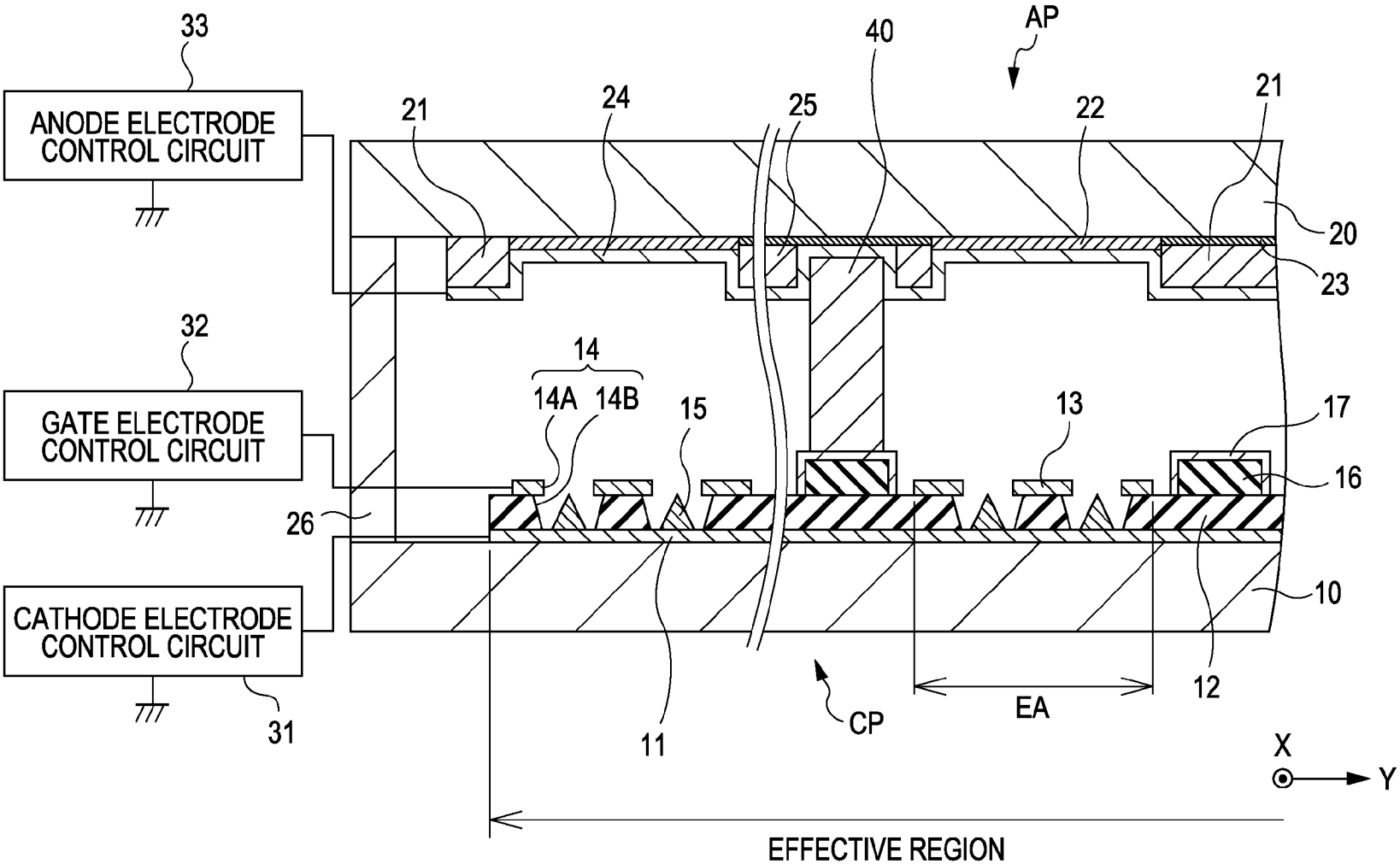
FIG. 9 is a conceptual partial end view showing a flat-panel display including a cold-cathode field electron emission display having a spinto-type cold-cathode field electron emission device.

In accordance with the first embodiment or the like, a field emission device constituting each electron emission region EA includes, for example, a spinto-type field emission device. As shown in FIG. 1 or 9, the spinto-type field emission device includes the following components:

(a) a cathode electrode 11 formed on a support 10;

(b) an insulating film 12 formed on the support 10 and the cathode electrode 11;

(c) a gate electrode 13 formed on the insulating layer 12;

(d) apertures 14 (first apertures 14A formed in the gate electrode 13 and second apertures 14B formed in the insulating layer 12) provided in the gate electrode 13 and the insulating layer 12; and (e) a conical electron emission part 15 formed on the cathode electrode 11 to be disposed at the bottom of each of the apertures 14.

Figure 10:
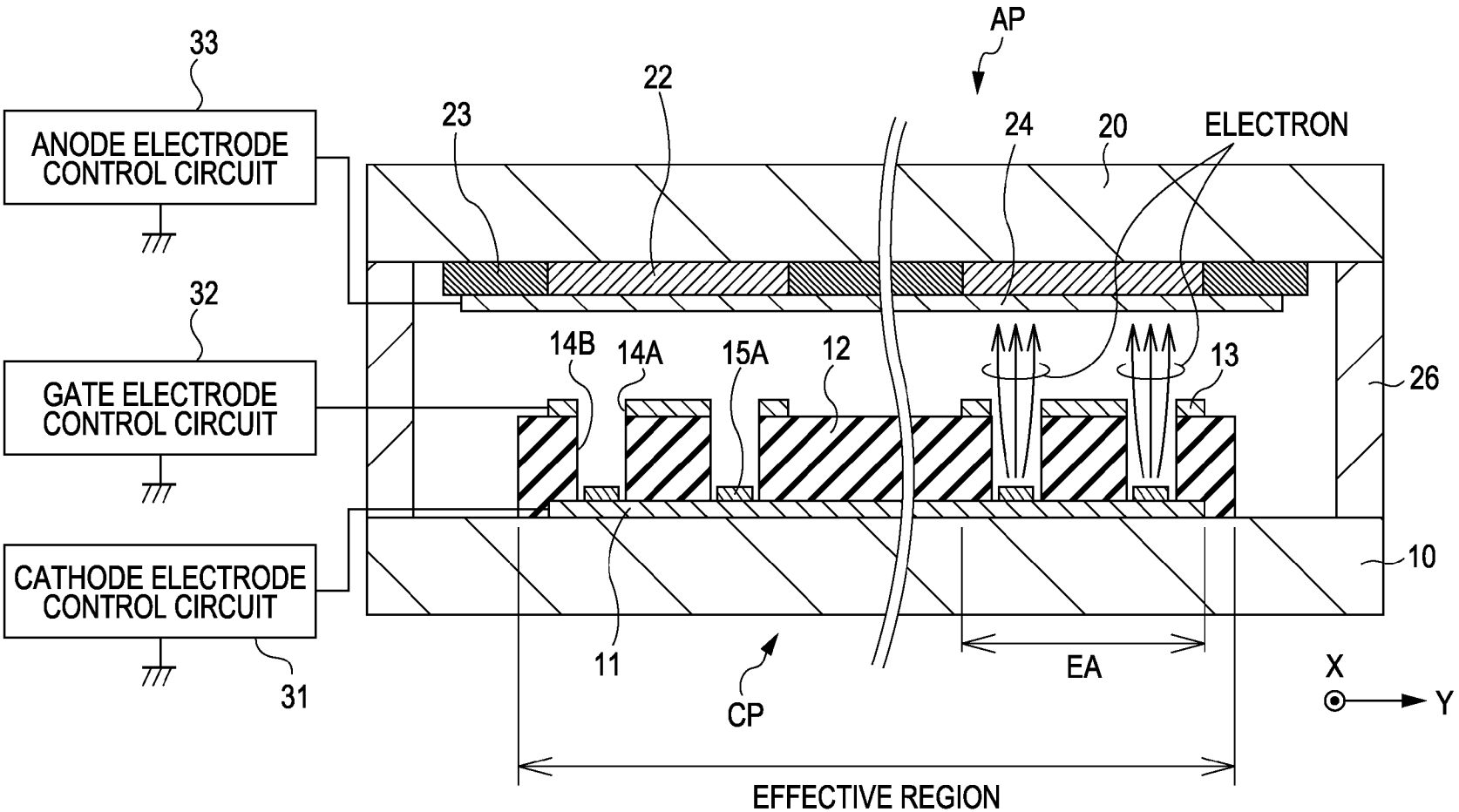
FIG. 10 is a conceptual partial end view showing a flat-panel display including a cold-cathode field electron emission display having a flat-type cold-cathode field electron emission device.
Figure 11:
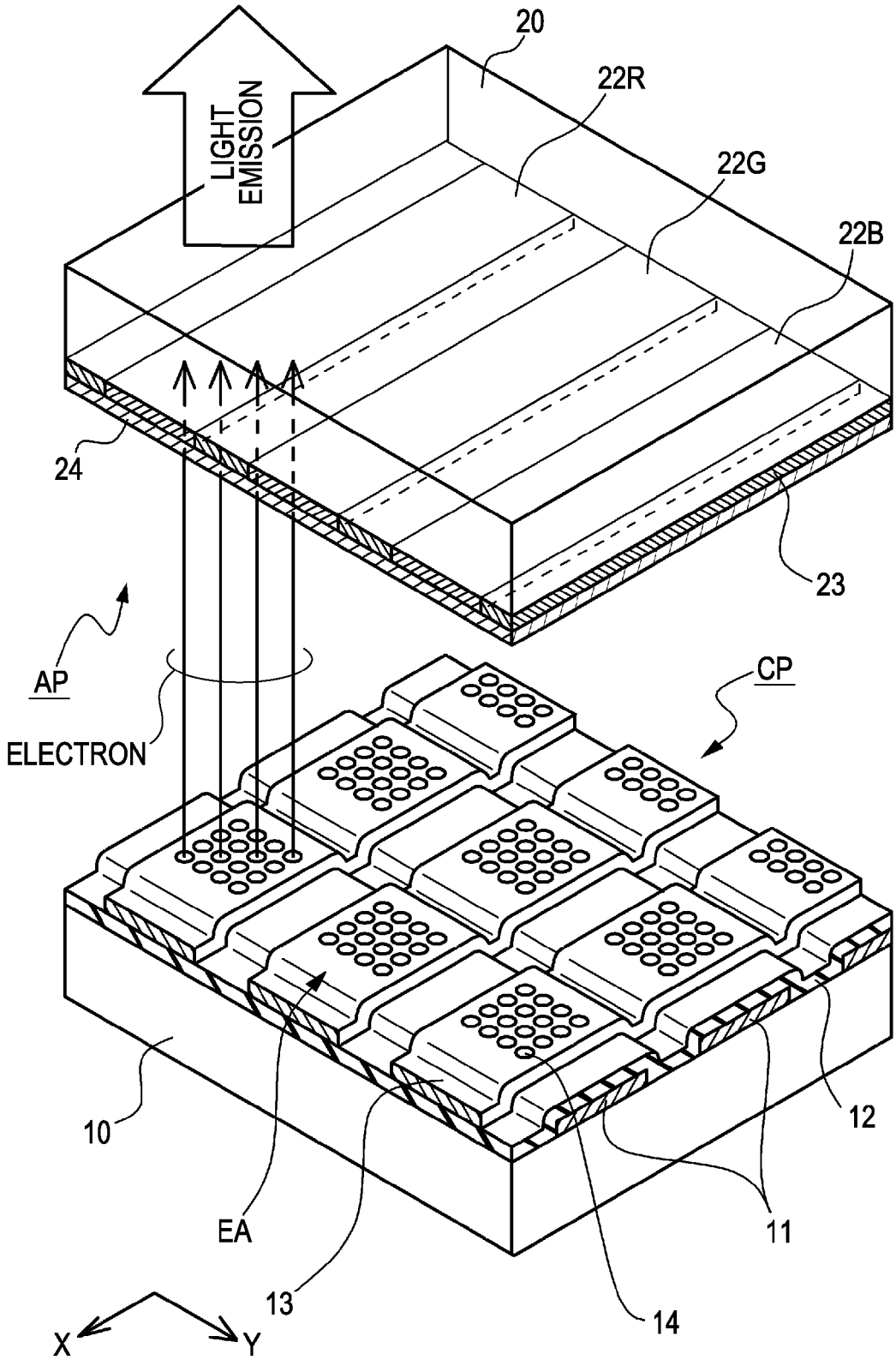
FIG. 11 is an exploded schematic partial perspective view showing a cathode panel and an anode panel in a cold-cathode field electron emission display.
Figure 12:
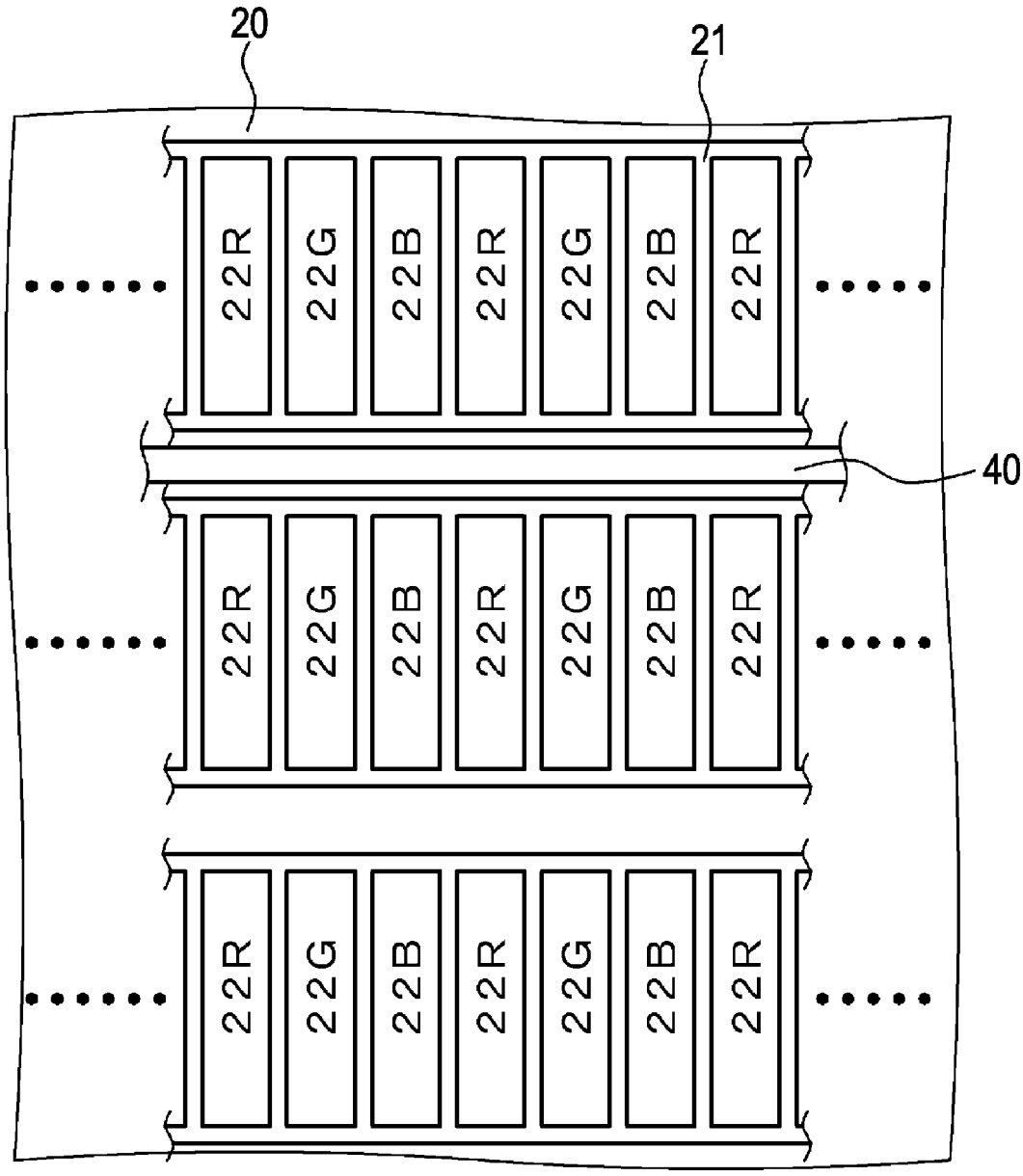
FIG. 12 is a schematic view showing the arrangement of partition walls, spacers, and fluorescent layers on an anode panel constituting a flat-panel display.
Figure 13:
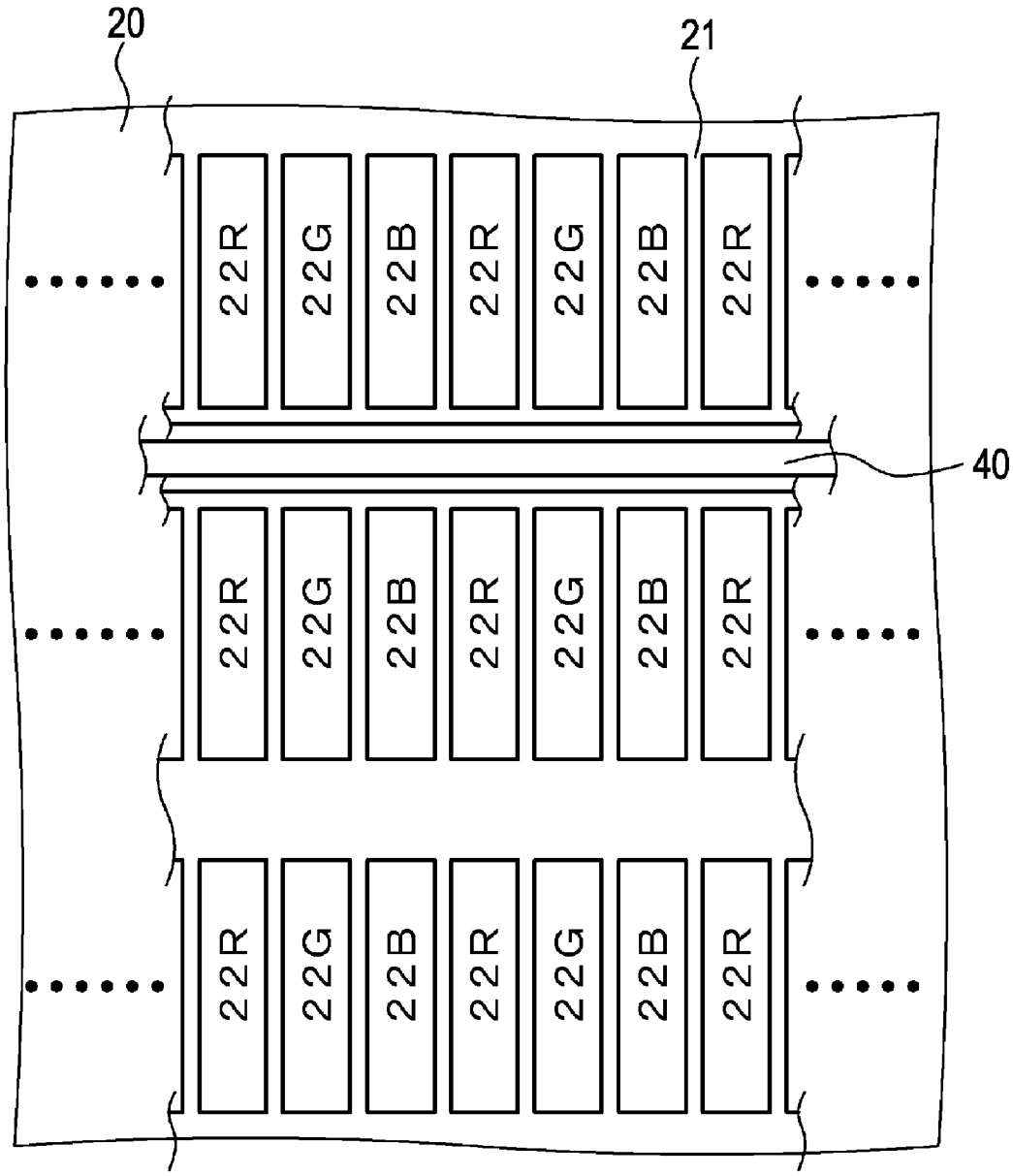
FIG. 13 is a schematic view showing the arrangement of partition walls, spacers, and fluorescent layers on an anode panel constituting a flat-panel display.
Figure 14:
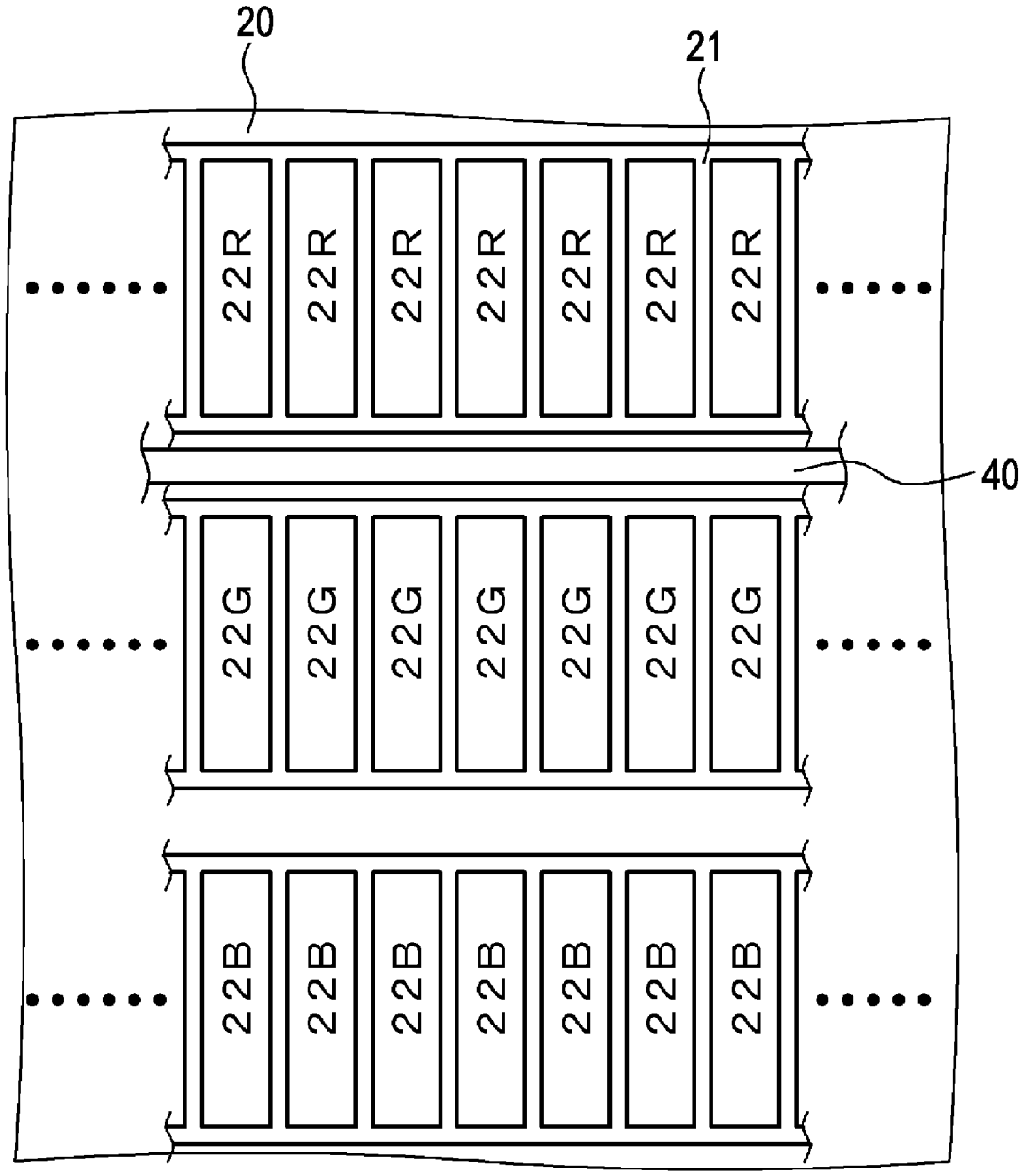
FIG. 14 is a schematic view showing the arrangement of partition walls, spacers, and fluorescent layers on an anode panel constituting a flat-panel display.
Figure 15:
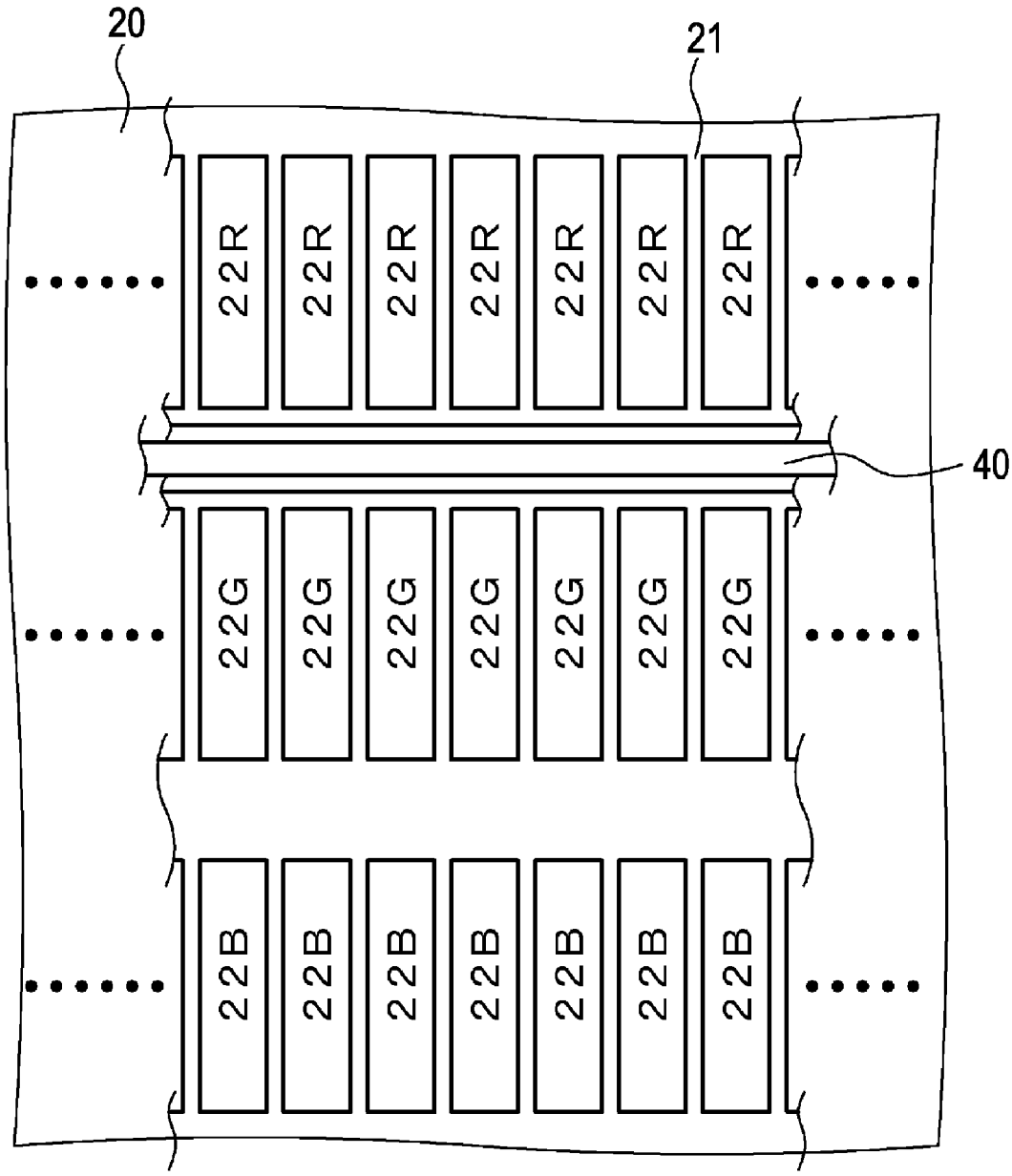
FIG. 15 is a schematic view showing the arrangement of partition walls, spacers, and fluorescent layers on an anode panel constituting a flat-panel display.
Figure 16:
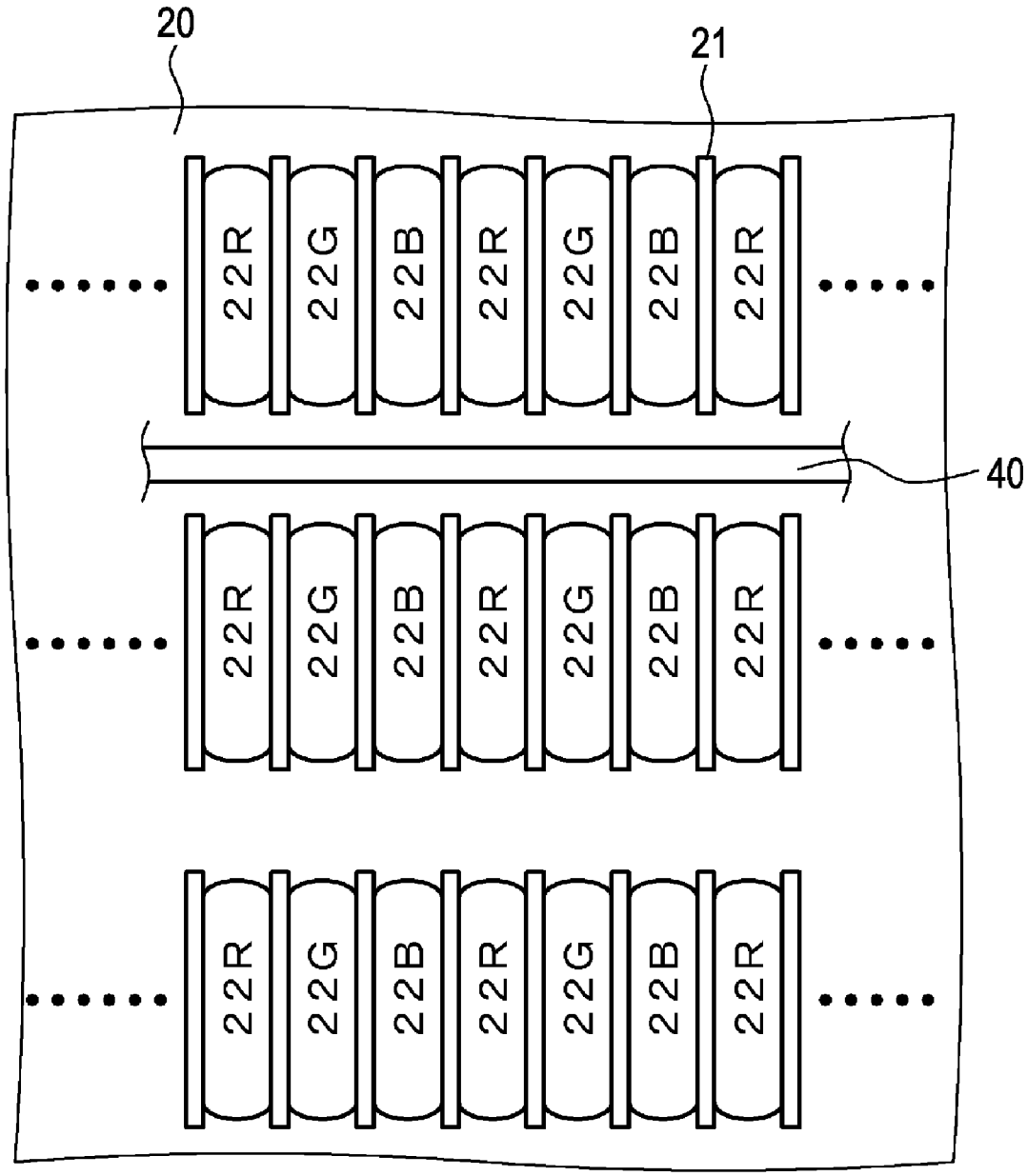
FIG. 16 is a schematic view showing the arrangement of partition walls, spacers, and fluorescent layers on an anode panel constituting a flat-panel display.
Figure 17:
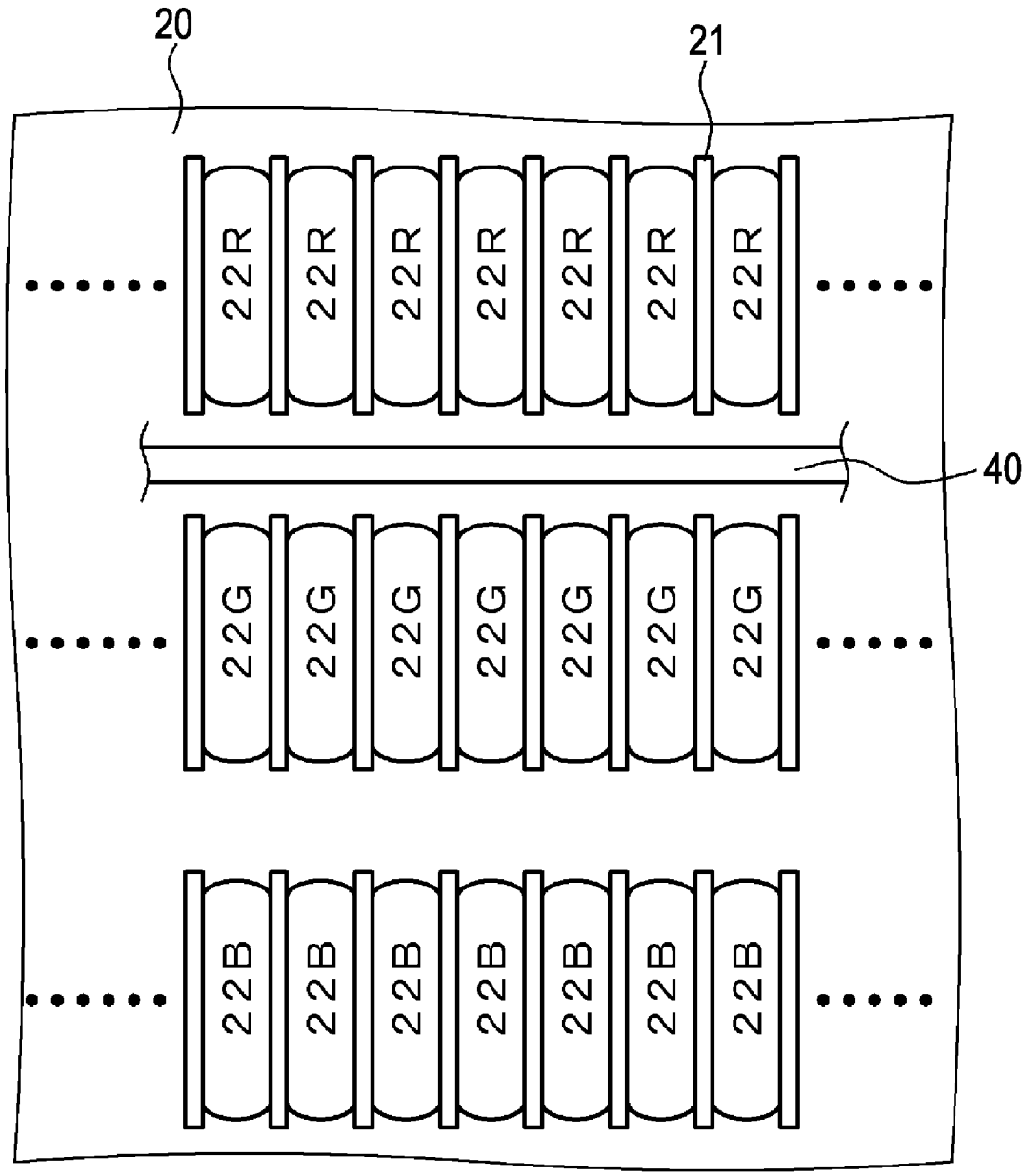
FIG. 17 is a schematic view showing the arrangement of partition walls, spacers, and fluorescent layers on an anode panel constituting a flat-panel display.
Figure 18:
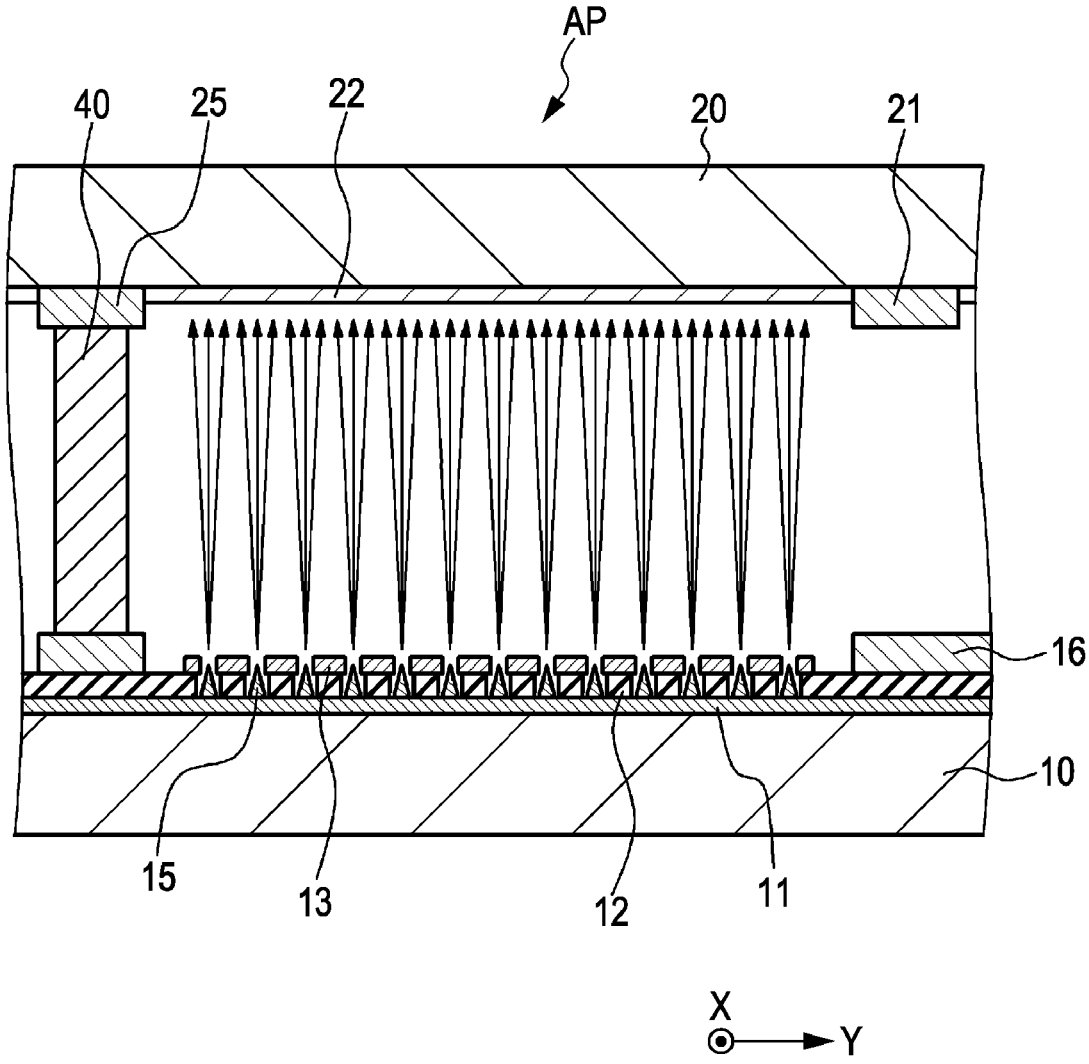
FIG. 18 is a schematic view showing electron beam orbits near spacers.
Figure 19:
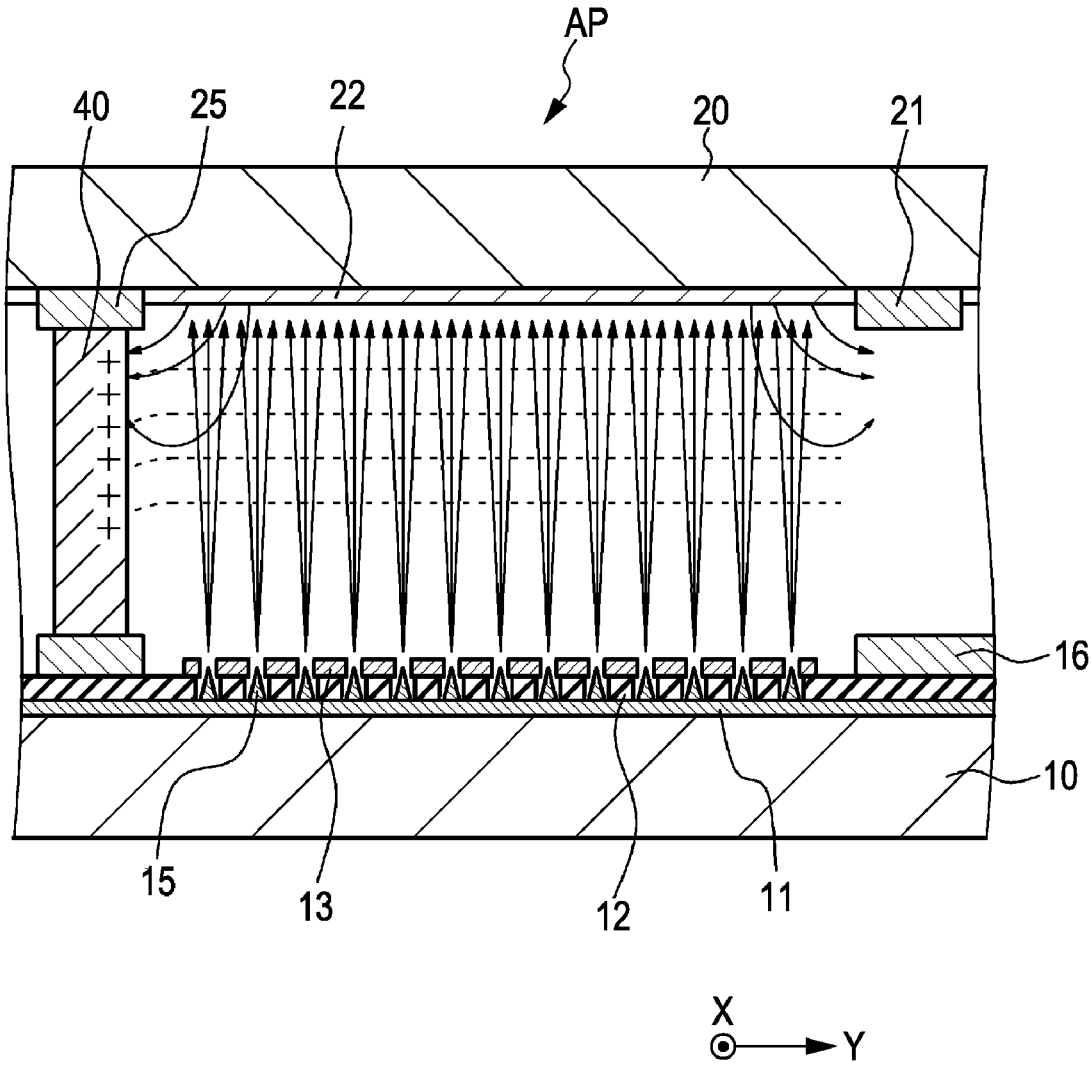
FIG. 19 is a schematic view showing electron beam orbits near spacers.
Figure 20:
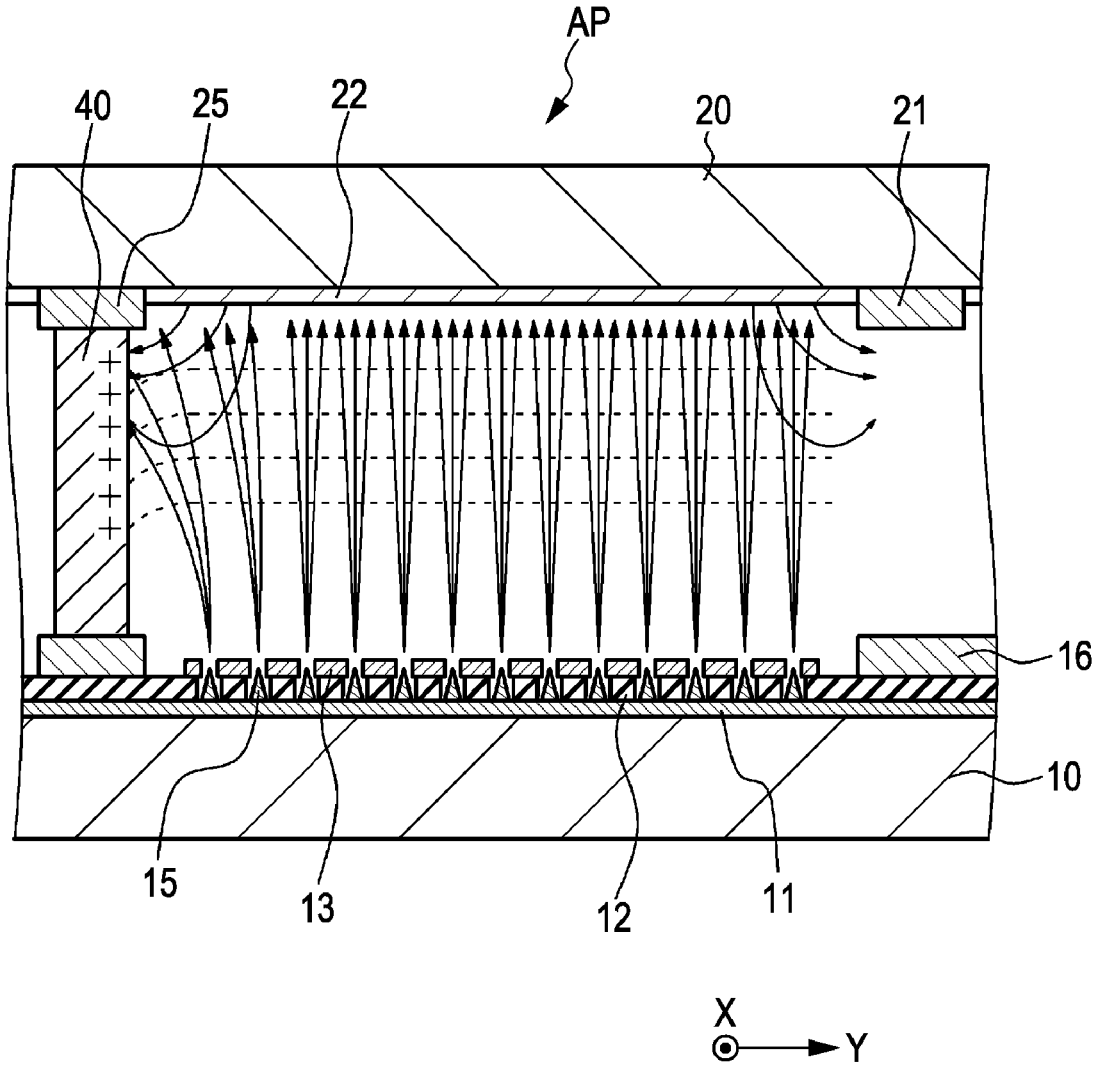
FIG. 20 is a schematic view showing electron beam orbits near spacers.
Figure 21:
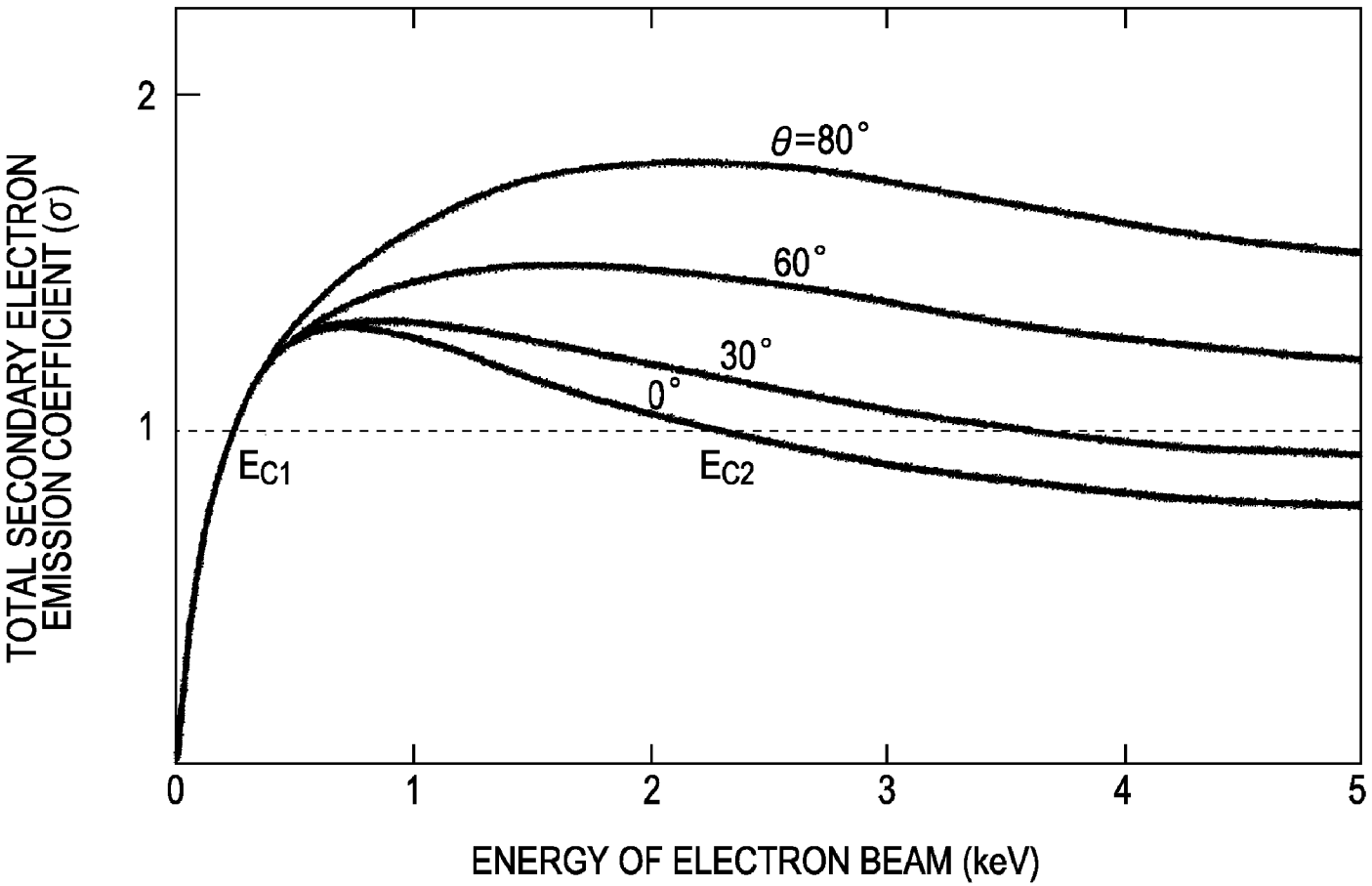
FIG. 21 is a graph showing a relation between electron beam energy and total secondary electron emission coefficient (TSEEY)
Figure 22A:
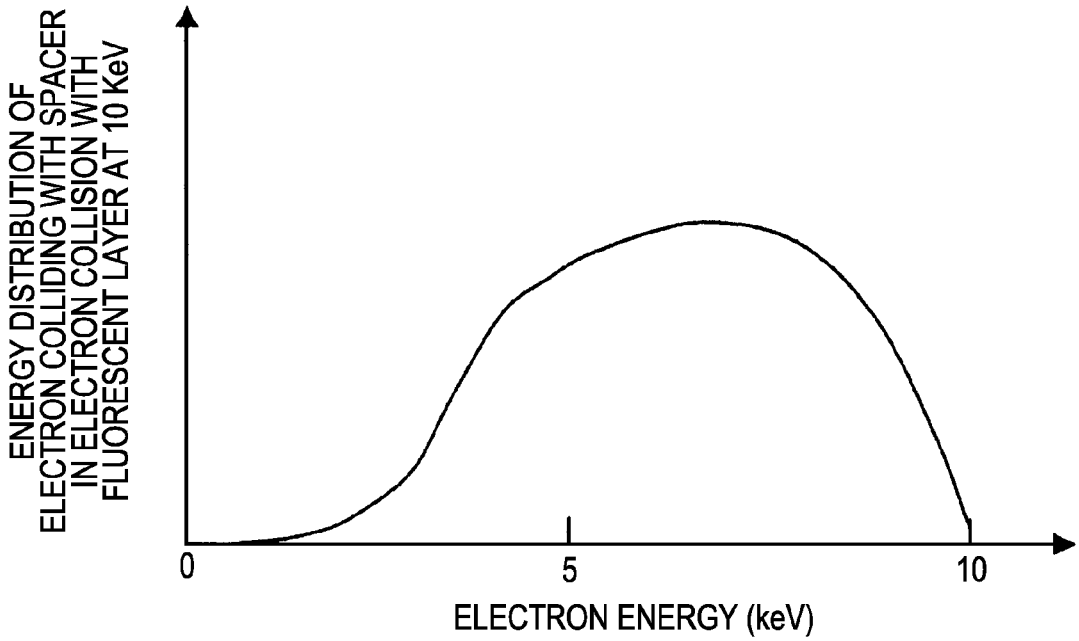
FIGS. 22A and 22B are graphs respectively showing an energy distribution and an angle distribution of electrons colliding with spacers.
Figure 22B:
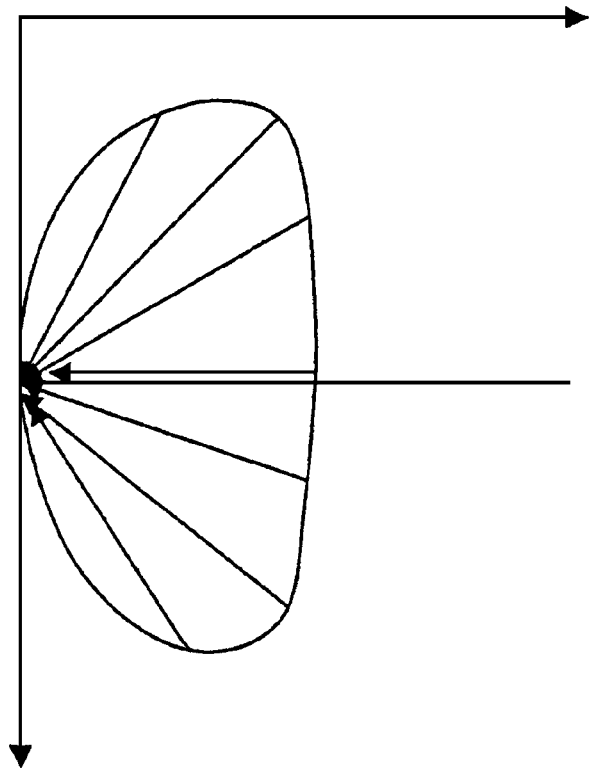

Alternatively, in the first embodiment or the like, the field emission device includes, for example, a flat-type field emission device. As shown in FIG. 10, the flat-type field emission device includes the following components:

(a) a cathode electrode 11 formed on a support 10;

(b) an insulating film 12 formed on the support 10 and the cathode electrode 11;

(c) a gate electrode 13 formed on the insulating layer 12;

(d) apertures 14 (first apertures 14A formed in the gate electrode 13 and second apertures 14B formed in the insulating layer 12) provided in the gate electrode 13 and the insulating layer 12; and (e) an electron emission part 15A formed on the cathode electrode 11 to be disposed at the bottom of each of the apertures 14.

The electron emission part 15A includes, for example, many carbon nanotubes partially buried in a matrix.

Furthermore, an interlayer insulating layer 16 is formed on the insulating layer 12 and the gate electrode 13, and a converging electrode 17 composed of aluminum of 0.4 μm in thickness is provided by DC sputtering on the interlayer insulating layer 16. The converging electrode 17 exhibits a common converging effect on a plurality of field emission devices. The interlayer insulating layer 16 has a third aperture 14C formed therein to communicate with the first apertures 14A. Furthermore, a through hole (not shown in the drawings) for evacuation is provided in an ineffective region of the cathode panel CP, and an exhaust tube (not shown in the drawings) also referred to as a "chip tube" is attached to the through hole, the exhaust tube being sealed after evacuation.

In the cathode panel CP according to the first embodiment or the like, the cathode electrodes 11 is stripe electrodes extending in a first direction (Y direction), and the gate electrodes 13 is stripe electrodes extending in a second direction (X direction) different from the first direction. The cathode electrodes 11 and the gate electrodes 13 are formed in stripes so that the projective images of both electrodes 11 and 13 are perpendicular to each other. The overlap regions between the stripe-shaped cathode and gate electrodes 11 and 13 serve as the respective electron emission regions EA. In each electron emission region EA corresponding to a sub-pixel, a plurality of field emission devices is provided. The electron emission regions EA corresponding to respective sub-pixels are arranged in a two-dimensional matrix in the effective region of the cathode panel CP.

In accordance with the first embodiment or the like, the anode panel AP includes a substrate 20, the fluorescent layers 22 (in a color display, red light-emitting fluorescent layers 22R, green light-emitting fluorescent layers 22G, and blue light-emitting fluorescent layers 22B) formed on the substrate 20, and an anode electrode 24 covering the fluorescent layers 22. More specifically, the anode panel AP includes the substrate 20, the fluorescent layers 22 (the red light-emitting fluorescent layers 22R, the green light-emitting fluorescent layers 22G, and the blue light-emitting fluorescent layers 22B) composed of many fluorescent particles and formed between partition walls 21 formed on the substrate 20, and the anode electrode 24 formed on the fluorescent layers 22. The anode electrode 24 is composed of aluminum (Al) of about 0.3 μm in thickness and includes a sheet covering the effective region. Also, the anode electrode 24 is provided to cover the partition walls 21 and the fluorescent layers 22. Furthermore, light absorbing layers (black matrix) 23 are formed between the fluorescent layers 22 and between the partition walls 21 and the substrate 20, for preventing the occurrence of color blurring of a display image or optical crosstalk. The space between the cathode panel CP and the anode panel AP is a vacuum space (pressure: for example, $10^{-3}$ Pa or less).

FIGS. 12 to 17 schematically show examples of the arrangement of the partition walls 21, the spacers 40, and the fluorescent layers 22. The arrangement of the fluorescent layers, etc. in the display shown in FIG. 9 or 10 corresponds to the arrangement shown in FIG. 13 or 15. In FIGS. 12 to 17, the anode electrode is omitted. The planar shape of the partition walls 21 may be a lattice shape (double-crossed shape), i.e., a shape surrounding each fluorescence layer 22 having a substantially rectangular planar shape corresponding to one sub-pixel, (refer to FIGS. 12, 13, 14, and 15); or a stripe shape extending in parallel to the two opposite sides of each fluorescent layer having a substantially rectangular shape (or a stripe shape) (refer to FIGS. 16 and 17). In the fluorescent layers 22 shown in FIG. 16, the fluorescent layers 22R, 22G, and 22B may be formed in stripes expending in the longitudinal direction of FIG. 16. The partition walls 22 may partially function as spacer holding parts 25 for holding the spacers 40.

Each sub-pixel includes one electron emission region EA on the cathode panel CP and the fluorescent layer 22 on the anode panel AP which faces a group of the field emission devices. For example, the sub-pixels of the order of hundreds of thousands to millions are arrayed in the effective region. In a color display, one pixel includes a group of a red light-emitting sub-pixel, a green light-emitting sub-pixel, and a blue light-emitting sub-pixel.

In accordance with the first embodiment or the like, the cathode electrodes 11 are connected to a cathode electrode control circuit 31, the gate electrodes 13 are connected to a gate electrode control circuit 32, the converging electrode 17 is connected to a converging electrode control circuit (not shown), and the anode electrode 24 is connected to an anode electrode control circuit 33. Each of these control circuits is a known circuit. In an actual operation of the display, the anode voltage VA applied from the anode electrode control circuit 33 to the anode electrode 24 is generally constant at, for example, 5 kV to 15 kV and more specifically 9 kV (for example, $d_0$=2.0 mm). On the other hand, in an actual operation of the display, the voltage $V_C$ applied to the cathode electrodes 11 and the $V_G$ applied to the gate electrodes 13 may be controlled by any of the following systems:

(1) the voltage $V_C$ applied to the cathode electrodes 11 is constant, and the $V_G$ applied to the gate electrodes 13 is changed;

(2) the voltage $V_C$ applied to the cathode electrodes 11 is changed, and the $V_G$ applied to the gate electrodes 13 is constant; and (3) the voltage $V_C$ applied to the cathode electrodes 11 and the $V_G$ applied to the gate electrodes 13 are changed.

In an actual operation of the display, the relatively negative voltage ($V_C$) is applied to the cathode electrodes 11 from the cathode electrode control circuit 31, and the relatively positive voltage ($V_G$) is applied to the gate electrodes 13 from the gate electrode control circuit 32. In addition, for example, 0 vole is applied to the converging electrode 17 from the converging electrode control circuit, and a positive voltage (the anode voltage $V_A$) higher than that of the gate electrodes 13 is applied to the anode electrode 24 from the anode electrode control circuit 33. In this display, for example, a scanning signal is input to the cathode electrodes 11 from the cathode electrode control circuit 31, and a video signal is input to the gate electrodes 13 from the gate electrode control circuit 32. Alternatively, a video signal may be input to the cathode electrodes 11 from the cathode electrode control circuit 31, and a scanning signal may be input to the gate electrodes 13 from the gate electrode control circuit 32. When a voltage is applied between the cathode electrodes 11 and the gate electrode 13 to produce an electric field, electrons are emitted from the electron emission parts 15 or 15A on the basis of the quantum tunneling effect, attracted to the anode electrode 24, pass through the anode electrode 24, and collide with the fluorescent layers 22. As a result, the fluorescent layers 22 are exited to emit light, thereby obtaining a desired image. In other words, the operation of the display is basically controlled by the voltage $V_G$ applied to the gate electrodes 13 and the voltage $V_C$ applied to the cathode electrodes 11.

In the first embodiment or the like, a high resistance layer is provided between each spacer 40 and the anode panel AP, and a conductor layer 42 is formed on a portion of each spacer 40 which contacts the cathode panel, specifically contacts the converging electrode 17.

In accordance with the first embodiment, the high-resistance layer 41 is formed on a portion of each spacer 40 which contacts the anode electrode 24, and more specifically, formed from the top surface in contact with the anode electrode to an upper portion of the side surface of each spacer 40. In the first embodiment, the high-resistance layer 41 has a sheet resistivity of $1\times10^{-2}$ Ω·m$^2$ to $1\times10^{5}$ Ω·m$^2$.

More specifically, in accordance with the first embodiment or the second to fourth embodiments described below, the spacers 40 are composed of alumina ($Al_2O_3$, purity 99.8%), and titanium dioxide ($TiO_2$) is added as an additive to alumina in order to control the thermal expansion coefficient and resistivity of the spacers 40 to desired values. The resistance between the top surface and the side surface of each spacer 40 is about $1\times10^{10}$ Ω (about 10 GΩ, specific resistance about $6\times10^{7}$ Ω·m). The areas of the top and side surfaces of each spacer 40 are about $1.1\times10^{-5}$ m$^2$. In addition, the conductor layer 42 composed of platinum (Pt) of 0.2 μm in thickness is formed by DC sputtering on a portion of each spacer 40 which contacts the cathode panel CP (more specifically, the converging electrode 17), and more specifically formed from the bottom to a lower portion of the side surface of each spacer 40. The sectional shape of the conductor layer 42 taken along an assumed plane vertical to the axial line of each spacer 40 is a U-like shape. The sheet resistivity of the conductor layer 42 is $1\times10^{-3}$ Ω·m$^2$ or less, more specifically about $1\times10^{-4}$ Ω·m$^2$. Furthermore, an antistatic film 43 composed of chromium oxide ($CrO_x$) of 4 nm in thickness is formed on the side surface of each spacer 40 by RF sputtering. Chromium oxide has a relatively small secondary electron emission coefficient and is a very suitable material for antistatic films under a condition in which the spacers 40 are positively charged.

In accordance with the first embodiment, the high-resistance layer 41 formed from the top surface in contact with the anode electrode 24 to an upper potion of the side surface of each spacer 40 is composed of a SiC film of 0.2 μm in thickness and is formed by RF sputtering. The sectional shape of the high-resistance layer 41 taken along an assumed plane vertical to the axial line of each spacer 40 is also a U-like shape. The contact resistance of the high-resistance layer 41 is about $0.33\times10^{9}$ Ω, and the sheet resistivity of the high-resistance layer 41 is about $3.8\times10^{4}$ $\Omega\cdot m^2$. The voltage applied in measurement is 1 kV.

A method for assembling the display according to the first embodiment will be described below.

Step 100

A plurality of field emission devices (spinto-type field emission devices or flat-type field emission devices) constituting electron emission regions emitting electrons is formed on the support 10 to prepare the cathode panel CP. On the other hand, the fluorescent layers 22 with which electrons emitted from the electron emission region collide and the anode electrode 24 are formed on the substrate 20 to prepare the anode panel AP. Also, the spacers 40 are prepared.

Step 110

In order to assemble the display, specifically, the spacers 40 are attached to the spacer holding parts 25 which are provided in the effective region of the anode panel AP so that the anode electrode 24 contacts the high-resistance layers 41 of the spacers 40. The frame 26 is disposed in the ineffective region of the anode panel AP, and the anode panel AP and the cathode panel CP are combined together so that the fluorescent layers 22 oppose the electron emission regions EA. In this case, the conductor layers 42 constituting the respective spacers 40 are in contact with the converting electrode 17. Furthermore, frit glass is applied on the top and bottom surfaces of the frame 26. The frit glass is pre-fired at 350° C. for 20 minutes.

Step 120

Then, the whole assembly is transferred into a firing furnace and heat-treated in the firing furnace to finally fire the frit glass at a temperature of about 400° C. for about 30 minutes. The atmospheric pressure of firing may be either normal pressure or reduced pressure. The gas constituting the atmosphere may be air or an inert gas such as nitrogen gas or gas (e.g., Ar gas) belonging to the 0 group in the periodic table.

Step 130

Next, the whole assembly is discharged from the firing furnace, and the space surrounded by the cathode panel CP, the anode panel AP, and the frame 26 is evacuated through the through hole (not shown) and the exhaust tube (not shown). When the pressure in the space reaches about $10^{-4}$ Pa, the exhaust tube is sealed by heat melting. Before sealing, the whole display is preferably once heated and then cooled to release the residual gas into the space so that the residual gas is removed to the outside of the space by evacuation. In this way, a vacuum is formed in the space surrounded by the cathode panel CP, the anode panel AP, and the frame 26. Then, wiring connection to desired external circuits is performed to complete the display of the first embodiment. When the cathode panel CP and the anode panel AP are bonded together in a peripheral region with the frame 26 provided therebetween in a high vacuum atmosphere, a vacuum is formed in the space at the same time as bonding of the cathode panel CP and the anode panel AP.

For comparison, a display was assembled using spacers each having a conductor layer formed by DC sputtering and composed of platinum (Pt) of 0.2 μm in thickness instead of the spacers 40 each having the high-resistance layer 41 formed from the top surface in contact with the anode electrode 24 to an upper portion of the side surface. This display is referred to as the "display of a comparative example". The sheet resistivity of the conductor layer was $1\times10^{-3}$ $\Omega\cdot m^2$ or less, more specifically about $1\times10^{-4}$ $\Omega\cdot m^2$.

According to various tests, it was found that if the shift amount (each of the shirt amounts along the first direction and second direction) produced in the electron beam orbits is within ±5 μm, no problem occurs. In other words, if the shift amount (each of the shirt amounts along the first direction and second direction) of the orbits of the electron beams emitted from the electron emission regions EA adjacent to the spacers 40 along the first direction due to the electric fields, which are formed by the spacers 40, is within ±5 μm, the formed image is neither distorted near the spacers 40 nor significantly influenced, and the spacers 40 do not become visible.

Figure 2A:
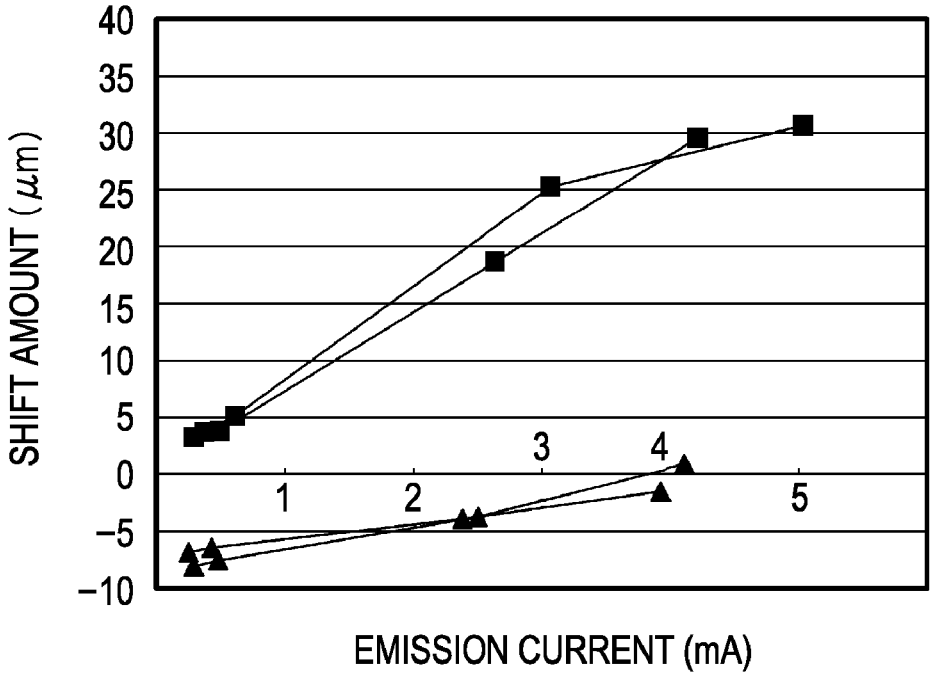
FIG. 2A is a graph showing the results of evaluation of the initial charged states of the side surfaces of spacers in the display according to the first embodiment and a display of a comparative example.

FIG. 2A shows the results of evaluation of the initial charged states of the side surfaces of spacers in the display according to the first embodiment and the display of the comparative example. In FIG. 2A, the shift amount (unit: μm) produced along the first direction in the orbits of the electron beams emitted from the electron emission regions EA adjacent to the spacers is shown as ordinate, and the emission current (unit: mA) is shown as abscissa. A positive shift amount indicates that the electron beams are bent in a direction nearer to the spacers. Similarly, FIG. 2B shows the shift amount measured by emitting electron beams form the electron emission regions EA adjacent to the spacers, photographing a luminous state of the fluorescent layers, determining the luminance center by image processing, and determining as the shift amount the distance between the luminance center and the original collision position of electron beams in the display.

In the display (shown by black square marks in FIG. 2A) of the comparative example, the shift amount increases as the emission current increases. This indicates that the positive charge accumulated in the spacers increases as the emission current increases. On the other hand, in the display (shown by black triangle marks in FIG. 2A) according to the first embodiment, the shift amount is extremely smaller than that in the display of the comparative example even when the emission current increases. This indicates that the positive charge accumulated in the spacers is not much increased even when the emission current increases. In the display of the comparative example, the spacers were made visible as the emission current increased. However, in the display according to the first embodiment, the spacers were not made visible even when the emission current increased.

Figure 2B:
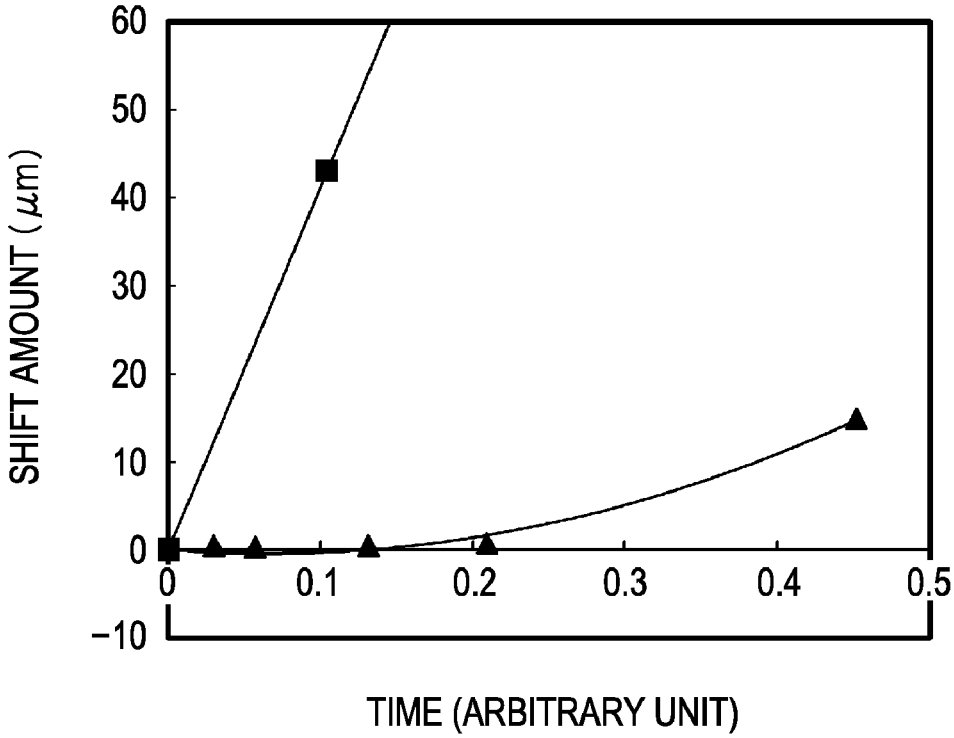
FIG. 2B is a graph showing the results of evaluation of changes with time in the shift amount produced in an electron beam orbit.

FIG. 2B shows the results of evaluation of changes with time in the shift amount of the orbits of electron beams. In FIG. 2B, the shift amount (unit: μm) produced long the first direction in the orbits of the electron beams emitted from the electron emission regions EA adjacent to the spacers is shown as ordinate, and the elapsed time (arbitrary unit) is shown as abscissa. The shift amount was measured on the basis of the initial shift amount (i.e., 0 μm) in an actual operation of the display. In the display of the comparative example, the amount of positive charge accumulated in the spacers is large, and consequently, the antistatic films are degraded (decreased in resistance) in the actual operation for a long time, thereby distorting the electric fields and bending the electron beam orbits. As a result, the shift amount is increased in an actual operation for a relatively short time. On the other hand, in the display of the first embodiment, the amount of positive charged accumulated in the spacers is small, and the antistatic films are little degraded (decreased in resistance) even in an actual operation for a long time, thereby little causing the phenomenon of distortion of the electric fields and bending of the electron beam orbits. As a result, the shift amount is extremely small even in an actual operation for a long time.

The results shown in FIGS. 2A and 2B reveal that the display according to the first embodiment maintains high display quality at an initial stage and in an actual operation for a long time.

Second Embodiment

Figure 3:
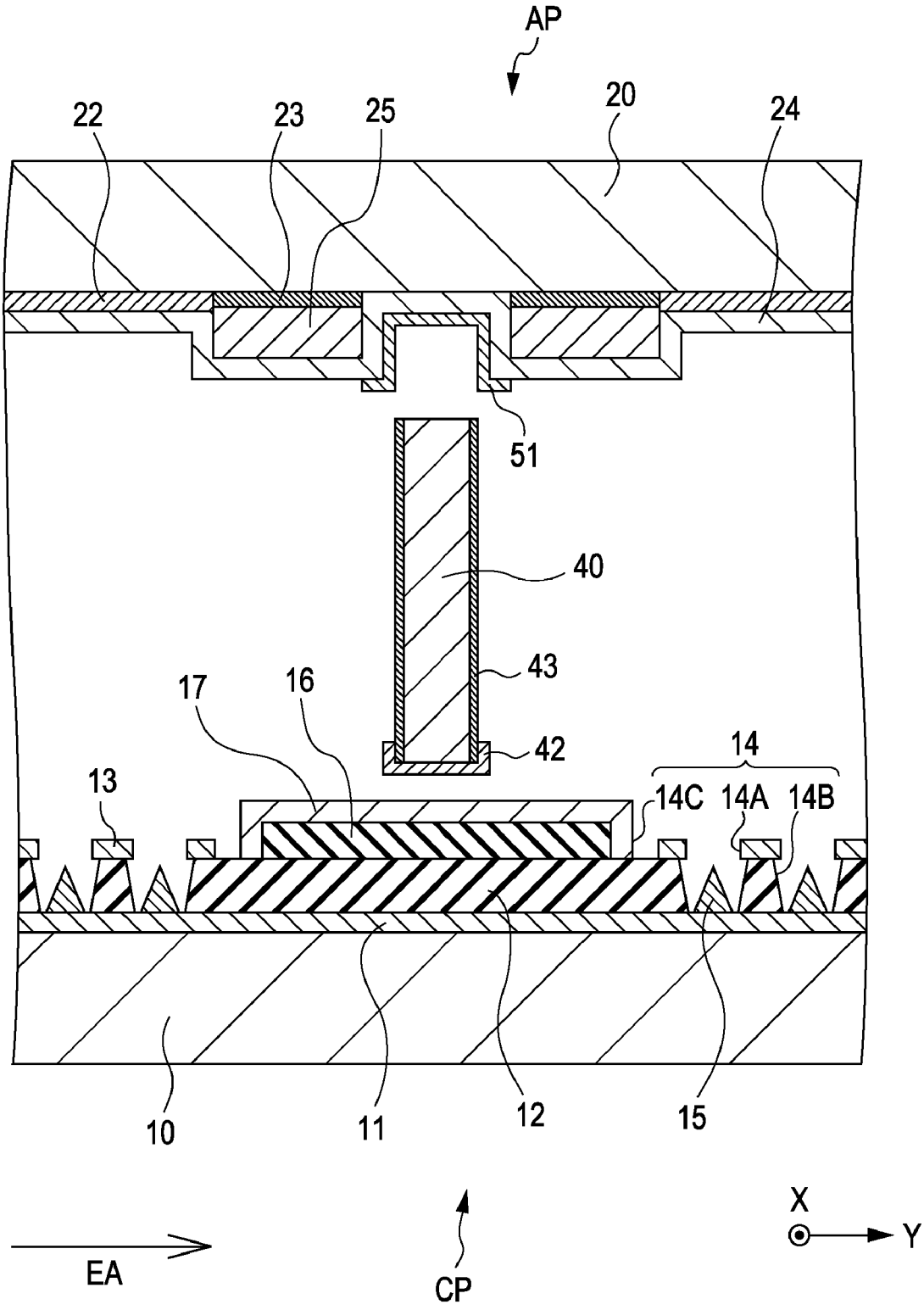
FIG. 3 is an enlarged schematic partial end view (exploded view) showing the vicinity of a spacer in a flat-panel display according to a second embodiment of the present invention.

The second embodiment is a modification of the first embodiment. FIG. 3 is an enlarged schematic partial end view (exploded view) showing the vicinity of a spacer. In the second embodiment, a high-resistance layer 51 is formed on a portion of the anode panel AP which contacts each spacer 40. Specifically, the high-resistance layer 51 is formed on a portion of the anode panel AP which contacts each spacer 40 and more specifically formed on a portion of the anode electrode 24 which is disposed on the bottoms, sides, and tops of the spacer holding parts 25. The high-resistance layer 51 is composed of a SiC film of 0.2 μm in thickness and is formed by RF sputtering. The contact resistance between the high-resistance layer 51 and each spacer 40 is about $0.33\times10^9$ Ω, and the sheet resistivity of the high-resistance layer 51 is about $0.33\times10^4$ $\Omega\cdot m^2$. The voltage applied in measurement is 1 kV.

The constitution, structure, and assembling method of the display according to the second embodiment may be the same as the display according to the first embodiment except the above-described points. Therefore, detailed description is omitted.

Third Embodiment

Figure 4:
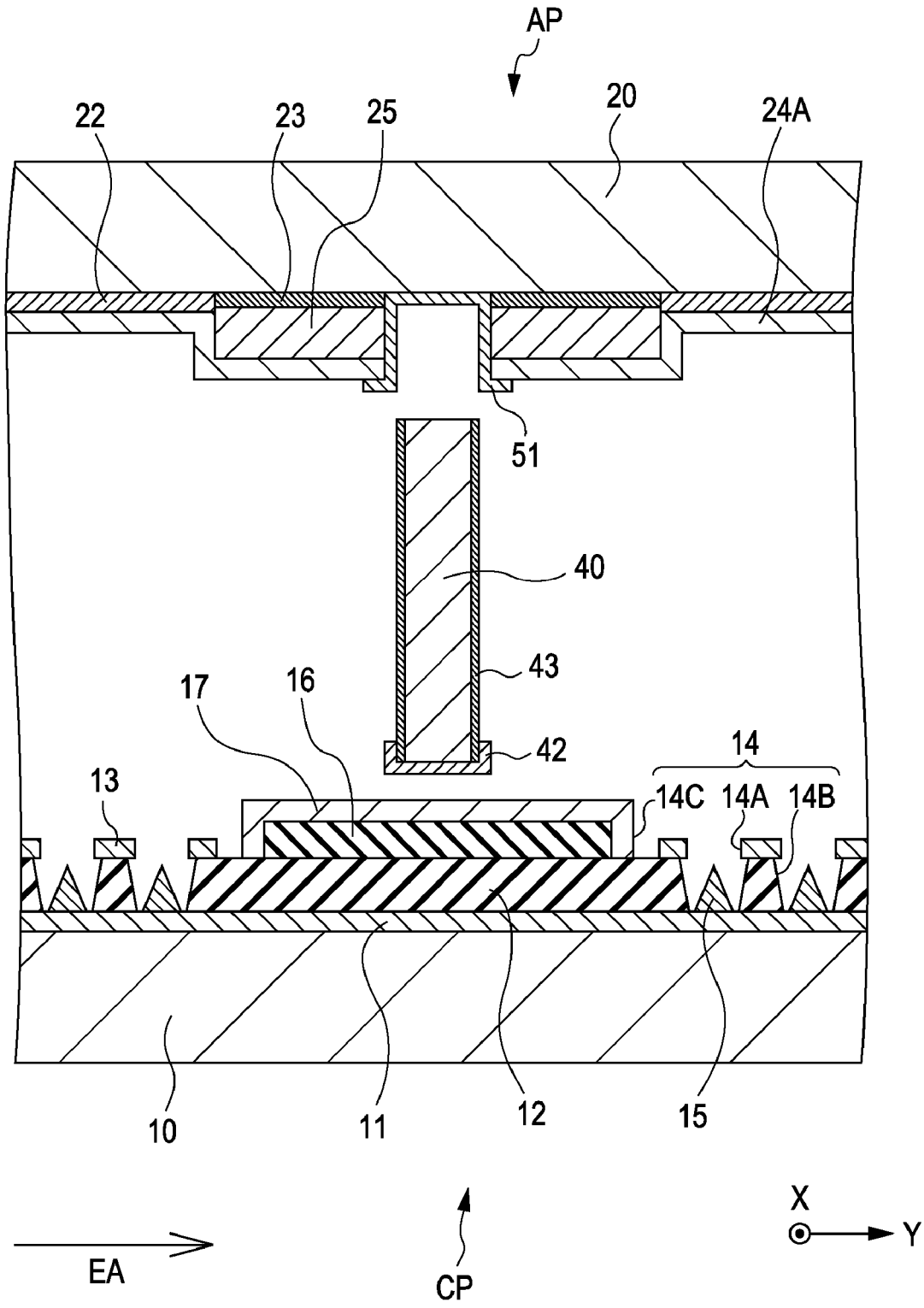
FIG. 4 is an enlarged schematic partial end view (exploded view) showing the vicinity of a spacer in a flat-panel display according to a third embodiment of the present invention.

The third embodiment is also a modification of the first embodiment. FIG. 4 is an enlarged schematic partial end view (exploded view) showing the vicinity of a spacer. In the third embodiment, a high-resistance layer 51 is formed on a portion of a substrate constituting an anode panel.

More specifically, in the flat-panel display according to the third embodiment, the anode electrode 24 includes a plurality of anode electrode units 24A. The high-resistance layer 51 extends to the anode electrode units 24A and is electrically connected to the anode electrode units 24A.

Figure 5:
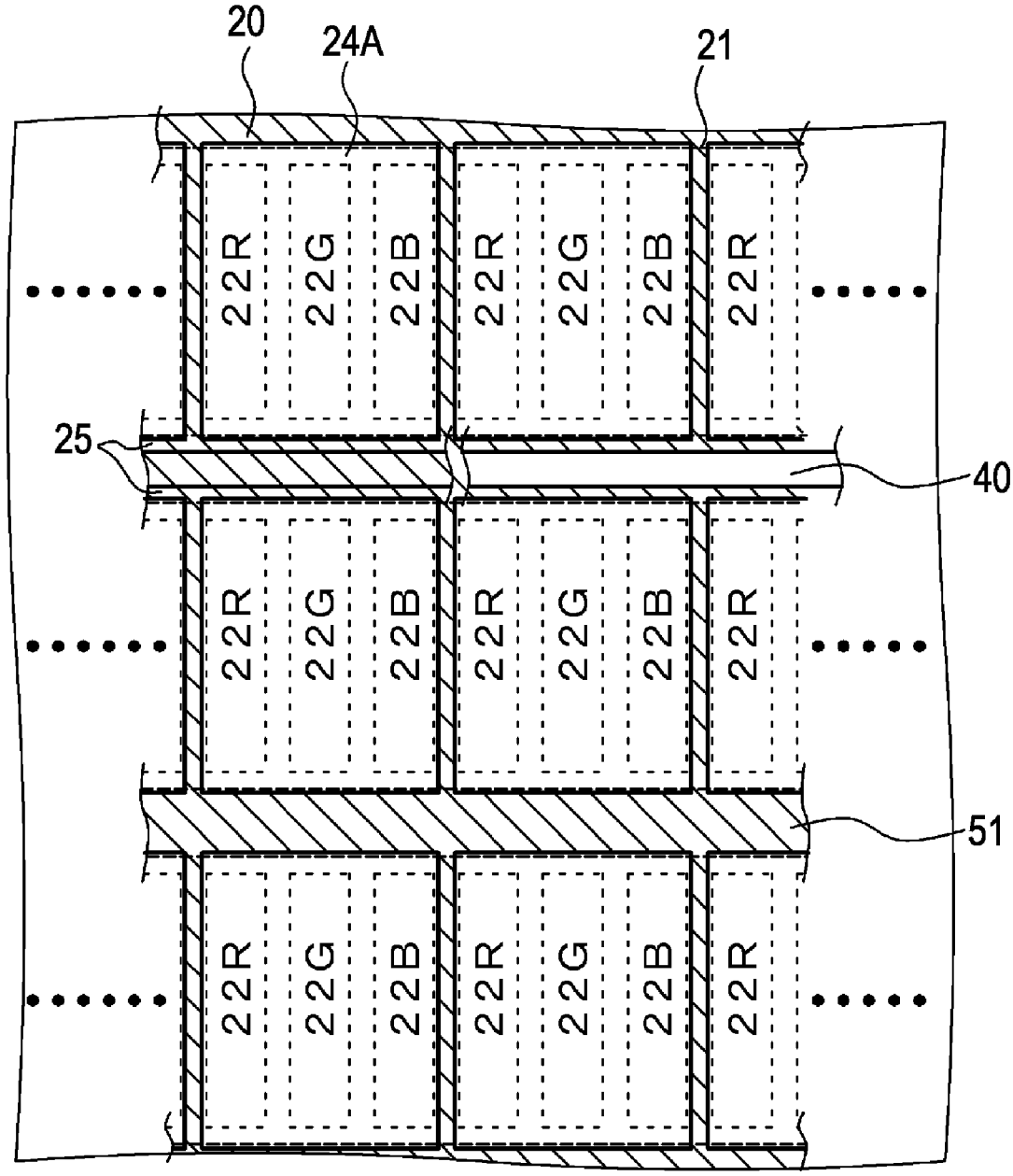
FIG. 5 is a schematic view showing the arrangement of anode electrode units, high-resistance layers, partition walls, spacer holding parts, spacers, and fluorescent layers on an anode panel constituting the flat-panel display according to the third embodiment.

FIG. 5 is a schematic view showing the arrangement of the anode electrode units 24A, the high-resistance layers 51, the partition walls 21, the spacer holding parts 25, the spacers 40, and the fluorescent layers 22 (22R, 22G, and 22B) on the anode panel AP constituting the flat-panel display of the third embodiment. FIG. 5 shows the partially cut-away spacers 40 for the convenience sake. As shown in FIG. 5, in the flat-panel display of the third embodiment, the anode electrode units 24A are divided for each region (specifically, a group of fluorescent layers 22R, 22G, and 22B) corresponding to one pixel, but are not limited to this.

Like in the first embodiment, the anode electrode units 24A are composed of aluminum (Al) of about 0.3 μm in thickness and are divided for each region corresponding to one pixel by a known patterning process. The high-resistance layers 51 are formed in the respective spaces between the adjacent anode electrode units 24A. More specifically, as shown in FIG. 4, each high-resistance layer 51 is formed over the space between the adjacent anode electrode units 24A. The high-resistance layer 51 shown in FIG. 4 has the same constitution as in the second embodiment described above with reference to FIG. 3 and thus is not described below.

The constitution, structure, and assembling method of the display according to the third embodiment may be the same as the display of the first embodiment except the above-described points.

As shown in FIGS. 4 and 5, in the display according to the third embodiment, the spacers 40 are in contact with the high-resistance layers 51. Since the spacers 40 are composed of a dielectric material, the capacitance between the anode electrode units 24A and the cathode electrodes 11 near the spacers 40 is increased, thereby decreasing the effect of preventing spark discharge. However, in the above-descried constitution, the spacers 40 are in contact with the high-resistance layers 51. When the spacers are in contact with the high-resistance layers 51, it may be possible to suppress the discharge current and thus compensate for a decrease in the spark discharge preventing effect due to an increase in capacitance. In the display shown in FIG. 4, when the antistatic film 43 is composed of a high-resistance material, the antistatic film 43 may be formed to extend to the anode panel-side top surface of each spacer 40.

Figure 6:
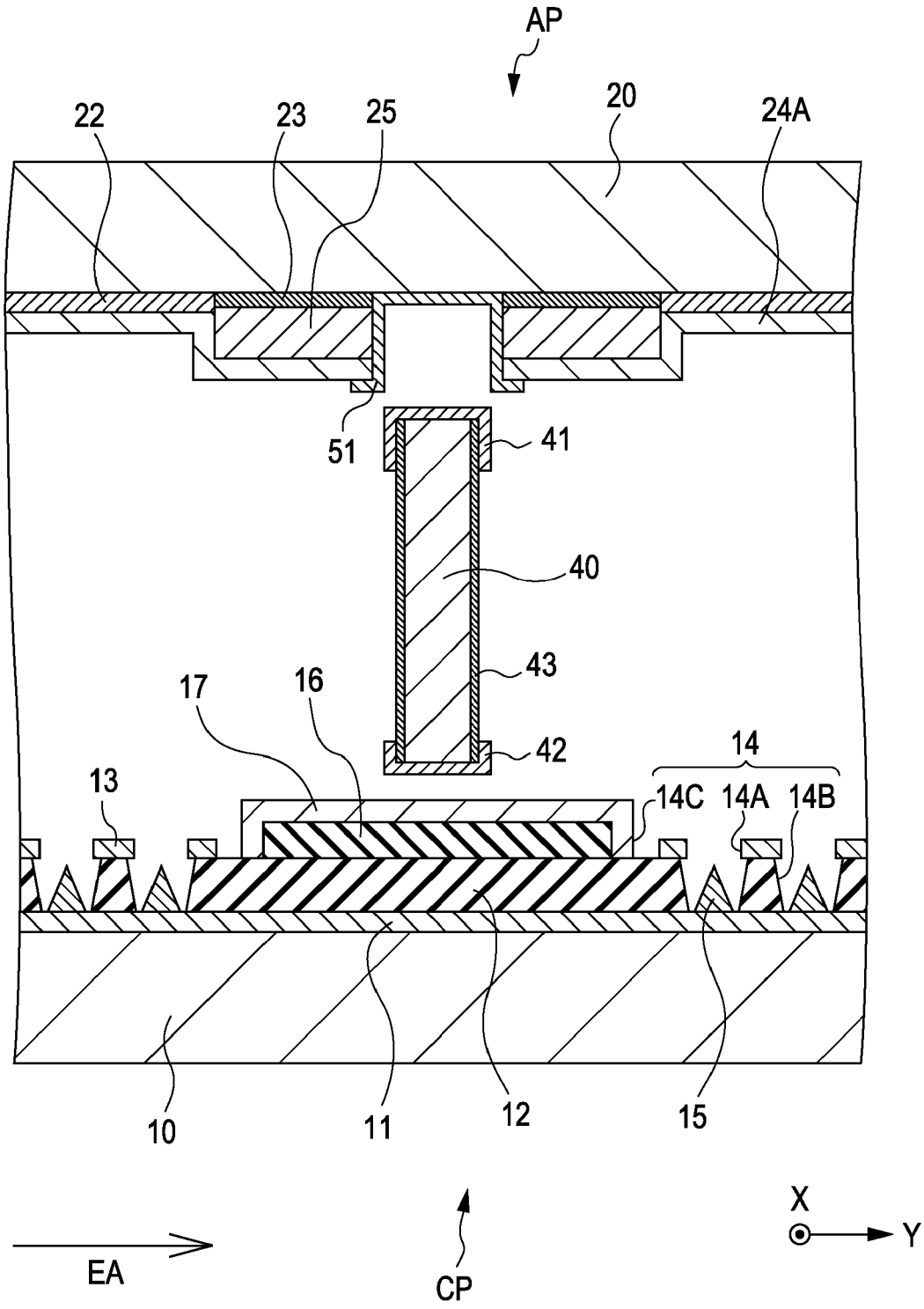
FIG. 6 is an enlarged schematic partial end view (exploded view) showing the vicinity of a spacer in a modified example of the flat-panel display according to the third embodiment of the present invention.

FIG. 6 is an enlarged schematic partial end view (exploded view) showing the vicinity of a spacer according to a modification of the third embodiment. In this modification, if required, a second high-resistance layer 41 may be provided on a portion of each spacer in contact with the high-resistance layer 51, for example, a portion extending from the top surface of each spacer in contact with the high-resistance layer to an upper portion of the side surface of each spacer. The second high-resistance layer 41 shown in FIG. 6 has the same constitution as the high-resistance layer 41 of the first embodiment described above with reference to FIG. 1 and is not described below.

Fourth Embodiment

Figure 7:
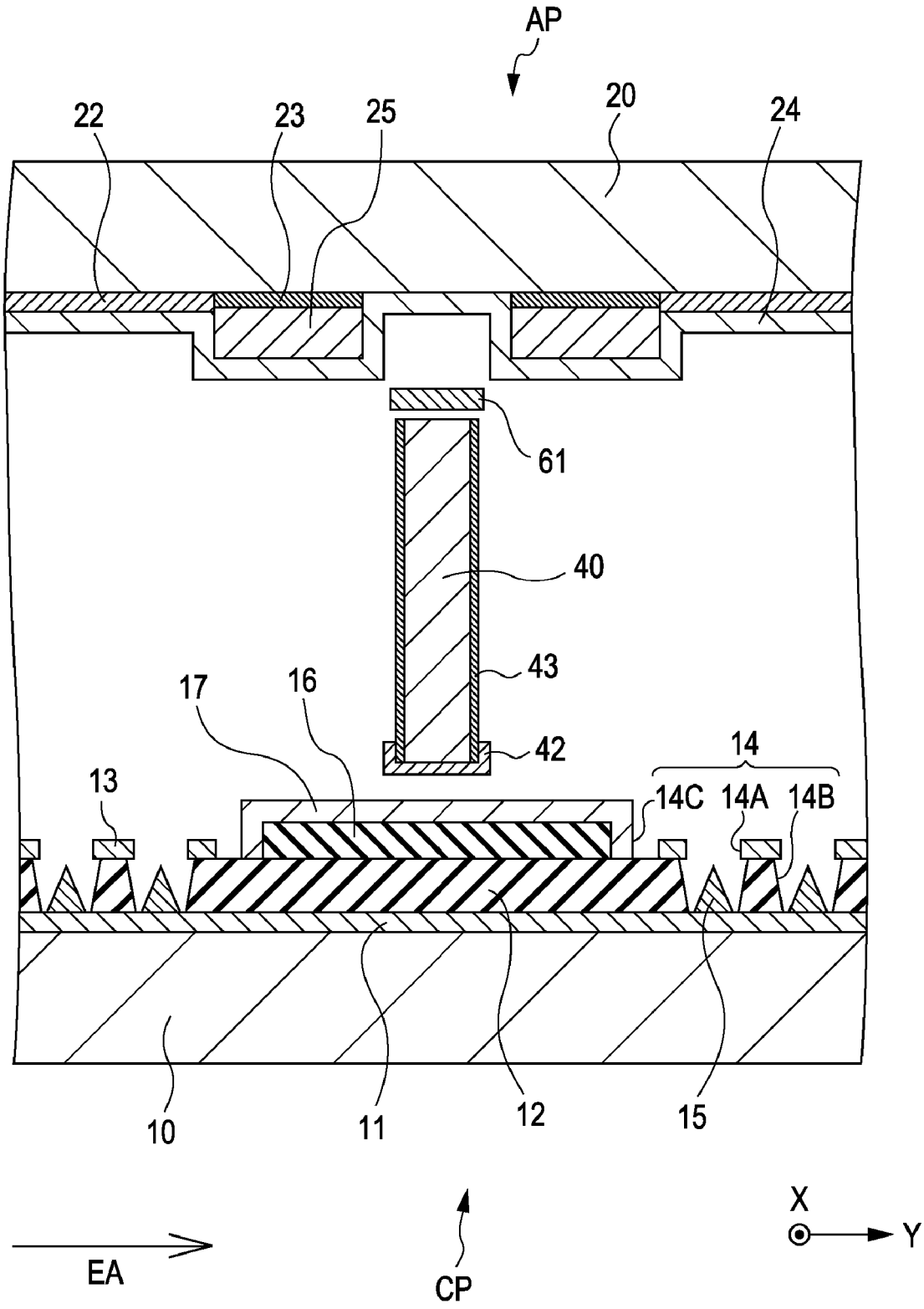
FIG. 7 is an enlarged schematic partial end view (exploded view) showing the vicinity of a spacer in a flat-panel display according to a fourth embodiment of the present invention.

The fourth embodiment is also a modification of the first embodiment. FIG. 7 is an enlarged schematic partial end view (exploded view) showing the vicinity of a spacer. In the fourth embodiment, a high-resistance layer includes a high-resistance member 61 held between the top surface of each spacer 40 and the anode electrode 24. More specifically, the high-resistance thin-plate member 61 is composed of high-resistance frit glass of several tens μm in thickness. In this case, the contact resistance of the high-resistance member 61 is about $0.33\times10^9$ Ω, and the sheet resistivity of the high-resistance member 61 is about $0.33\times10^4$ $\Omega\cdot m^2$. The contact resistance or sheet resistivity of the high-resistance member 61 means the contact resistance or sheet resistivity between the anode electrode 24 and each spacer 40 with the high-resistance member 61 provided therebetween. The voltage applied in measurement is 1 kV.

The constitution, structure, and assembling method of the display according to the fourth embodiment may be the same as the display of the first embodiment except the above-described points, and thus detailed description is omitted.

Although the preferred embodiments of the invention are described above, the invention is not limited to these embodiments. The above-described constitutions and structures of the flat-panel display, the cathode panel and the anode panel, the cold-cathode field electron emission display, and the cold-cathode field electron emission device according to any one the embodiments of the invention are only examples and may be appropriately changed. Also, the method for assembling the cold-cathode field electron emission display is also an example and may be appropriately changed. Furthermore, the various materials used in manufacturing the cold-cathode field electron emission display are examples and may be appropriately changed. The above-descried displays are color displays as an example, but may be monochrome displays. In some cases, the converging electrodes may not be formed.

In accordance with any one of the embodiments, the sectional shape of the conductor layer 42 along an assumed plane vertical to the axial line of each spacer 40 is a U-like shape but is not limited to this. The sectional shape of the conductor layer 42 may be basically any shape, for example, a shape in which the conductor layer 42 is formed only at the bottom of each spacer 40.

In accordance with the first embodiment, the sectional shape of the high-resistance layer 41 along an assumed plane vertical to the axial line of each spacer 40 is also a U-like shape but is not limited thereto. The sectional shape of the high-resistance layer 41 may be basically any shape, for example, a shape in which the high-resistance layer 41 is formed only at the top of each spacer 40.

In accordance with the second embodiment, the high-resistance layer 51 formed on a portion of the anode electrode 24 which is disposed on the bottoms, sides, and tops of the spacer holding parts 25, but are not limited to this. For example, the high-resistance layer 51 may be formed only at the bottom, the side, or the bottom and side of each spacer holding part 25, or may be formed on the planar anode electrode 24 depending on the mounting positions of the spacers 40.

In accordance with the fourth embodiment, the high-resistance member 61 has a thin plate shape, but is not limited to this. The shape of the high-resistance member 61 may be basically any shape, for example, a cap-like member having a U-shaped sectional shape taken along an assumed plane vertical to the axial line of each spacer 40.

Figure 8A:
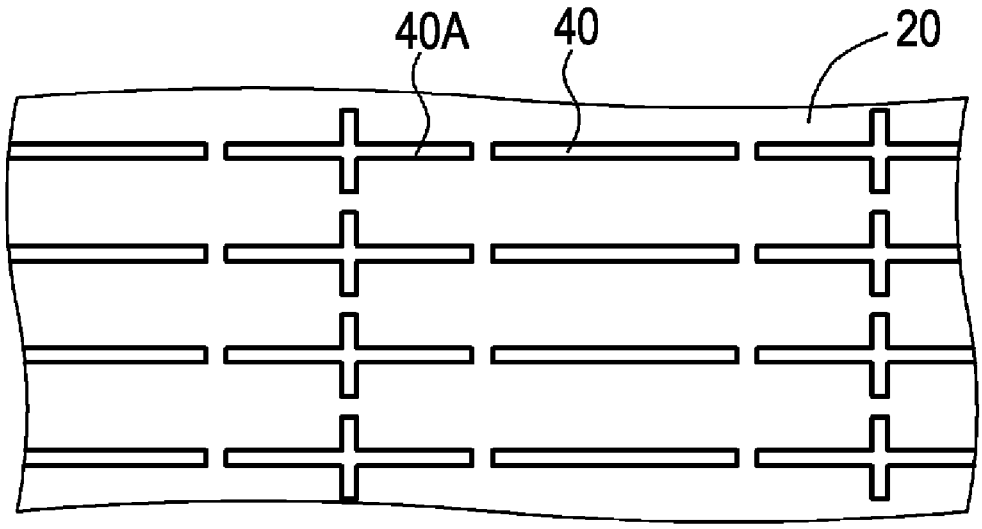
FIGS. 8A and 8B are conceptual partial plan views each showing a modified example of the shape of spacers.
Figure 8B:
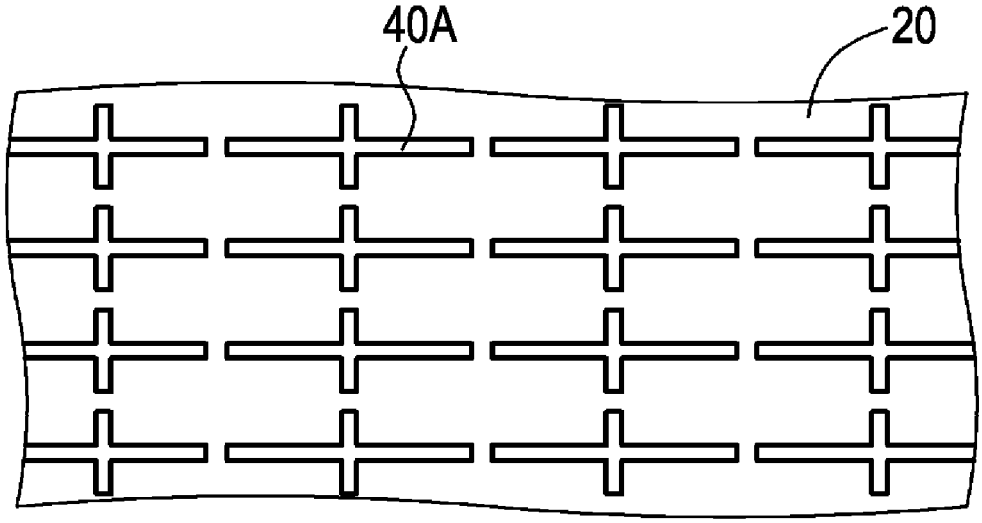

In accordance with any one of the embodiments, the spacers have a stripe shape but are not limited to this. As shown in FIG. 8A which is a conceptual partial plan view, cross-shaped spacers 40A may be combined with plate-like spacers 40. Alternatively, as shown in FIG. 8B which is a conceptual partial plan view, only cross-shaped spacers 40A may be used. The basic constitution and structure of the cross-shaped spacers 40A may be the same as the stripe-shaped spacers descried in the first to fourth embodiments.

Although, in the above-described embodiments, one electron emission part is formed in each aperture in the field emission device, a plurality of electron emission parts may be formed in each aperture or one electron emission part may be formed in a plurality of apertures, depending on the structure of the field emission device. Alternatively, a plurality of first apertures may be provided in a gate electrode, and a second aperture may be provided to communicate with the plurality of first apertures for an insulating layer so that at least one electron emission part may be provided.

Each electron emission region may include an electron emission device generically named "a surface-conduction electron-emission device. The surface-conduction electron-emission device includes a pair of electrodes which has a small area, is composed of a conductive material such as tin oxide ($SnO_2$), gold (Au), indium oxide ($In_2O_3$)/tin oxide ($SnO_2$), carbon, or palladium oxide (PdO), and disposed with a predetermined gap therebetween, the electrodes being formed in a matrix on a support composed of, for example, glass. Also, a carbon thin film is formed on each of the electrodes. Furthermore, row-direction wiring is connected to one of a pair of electrodes, and a column-direction wiring is connected to the other. When a voltage is applied to a pair of electrodes, an electric field is applied to the carbon thin films opposing with the gap therebetween, thereby emitting electrons from the carbon thin films. The electrons are caused to collide with fluorescent layers on an anode panel to excite the fluorescent layers and obtain a desired image. Alternatively, each electron emission region may include a metal/insulator/metal device.

It should be understood by those skilled in the art that various modifications, combinations, sub-combinations and alterations may occur depending on design requirements and other factors insofar as they are within the scope of the appended claims or the equivalents thereof.

What is claimed is:

1. A flat-panel display comprising:

a cathode panel including a plurality of electron emission regions, and an anode panel including a fluorescent layer and an anode electrode, both panels being bonded together in a peripheral region and holding a vacuum space therebetween;

a plurality of spacers disposed between the cathode panel and the anode panel;

a high-resistance layer provided between the anode panel and each of the spacers; and a conductor layer provided on a portion of each of the spacers which contacts the cathode panel, wherein, the sheet resistivity of the high-resistance layer is between about $1\times10^{-2}$ $\Omega.m^2$ and about $1\times10^{5}$ $\Omega.m^2$, and the sheet resistivity of the conductor layer is about $1\times10^{-3}$ $\Omega.m^2$ or less.

2. The flat-panel display according to claim 1, wherein the high-resistance layer is formed on a portion of each of the spacers which contacts the anode electrode.

3. The flat-panel display according to claim 1, wherein the high-resistance layer is formed on a portion of the anode panel which contacts each of the spacers.

4. The flat-panel display according to claim 3, wherein the anode electrode includes a plurality of anode electrode units, and the anode electrode units are electrically connected to each other with the high-resistance layer.

5. The flat-panel display according to claim 1, wherein the high-resistance layer includes a high-resistance member held between the top surface of each of the spacers and the anode electrode.

6. The flat-panel display according to claim 1, wherein the sheet resistivity of the high-resistance layer is 1 $\Omega m^2$ to $1\times10^{5}$ $\Omega m^2$.

* * * * *